US010698340B2

(12) United States Patent
Tsurusaki et al.

(10) Patent No.: US 10,698,340 B2
(45) Date of Patent: Jun. 30, 2020

(54) METHOD OF ATTACHING REGULATING BLADE AND DEVELOPMENT APPARATUS

(71) Applicant: CANON KABUSHIKI KAISHA, Tokyo (JP)

(72) Inventors: Teruaki Tsurusaki, Moriya (JP); Shunichi Koga, Abiko (JP); Tomohiro Shiomi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/451,854

(22) Filed: Jun. 25, 2019

(65) Prior Publication Data

US 2020/0004174 A1 Jan. 2, 2020

(30) Foreign Application Priority Data

Jun. 29, 2018 (JP) ..... 2018-125047
May 15, 2019 (JP) ..... 2019-092305

(51) Int. Cl.
*G03G 15/08* (2006.01)
*G03G 21/16* (2006.01)

(52) U.S. Cl.
CPC ..... *G03G 15/0812* (2013.01); *G03G 21/1676* (2013.01); *G03G 2215/0805* (2013.01); *G03G 2215/0866* (2013.01); *G03G 2215/0872* (2013.01)

(58) Field of Classification Search
CPC ..... G03G 15/0812; G03G 21/1676; G03G 2215/0805; G03G 2215/0866; G03G 2215/0872
See application file for complete search history.

(56) References Cited

U.S. PATENT DOCUMENTS 5,470,635 A * 11/1995 Shirai ..... G03G 21/0011 15/256.51
2005/0220501 A1* 10/2005 Toba ..... G03G 15/0812 399/284
2014/0321887 A1 10/2014 Matsumoto
2015/0023694 A1* 1/2015 Kanada ..... G03G 15/0812 399/119

FOREIGN PATENT DOCUMENTS

JP 2002-072671 A 3/2002
JP 2002-148908 A 5/2002
JP 2014-197175 A 10/2014
JP 2015-090398 A 5/2015
JP 2018-045227 A 3/2018

* cited by examiner

*Primary Examiner* — Joseph S Wong
(74) *Attorney, Agent, or Firm* — Canon U.S.A., Inc. I.P. Division

(57) ABSTRACT

A method of attaching a regulating blade made of resin to an attachment portion of a development frame which is made of resin and includes the attachment portion for attaching the regulating blade includes applying an adhesive to the attachment portion, applying a hardening accelerator to the regulating blade, and attaching the regulating blade to the attachment portion via the adhesive applied to the attachment portion and the hardening accelerator applied to the regulating blade. The regulating blade is disposed opposite to and not in contact with a development rotary member configured to bear and convey a developer toward a position at which an electrostatic image formed on an image bearing member is developed, and configured to regulate an amount of the developer to be borne on the development rotary member.

20 Claims, 17 Drawing Sheets

AMMONIA

PRIMARY AMINE
(AMINE COMPOUND)

METHOD OF ATTACHING REGULATING BLADE AND DEVELOPMENT APPARATUS

BACKGROUND OF THE INVENTION

Field of the Invention

The present disclosure relates to a method of bonding a regulating blade made of resin.

Description of the Related Art

A development apparatus includes a development frame, a developer bearing member, and a regulating blade. The developer bearing member bears a developer for developing an electrostatic latent image formed on an image bearing member. The regulating blade is a developer regulating member which regulates the amount (coating amount) of the developer borne on the developer bearing member. The regulating blade is disposed opposite to the developer bearing member along a longer-side direction of the developer bearing member with a predetermined gap, i.e., a sleeve-to-blade gap (hereinafter, referred to as "SB gap") between the regulating blade and the developer bearing member (development sleeve). The SB gap refers to the shortest distance between the developer bearing member and the regulating blade. The amount of the developer conveyed toward a position (development region where the developer bearing member faces the image bearing member) at which the electrostatic latent image formed on the image bearing member is developed is adjusted by adjusting the size of the SB gap.

In recent years, a development apparatus including a developer regulating member molded from and made of resin and a development frame molded from and made of resin is known (refer to Japanese Patent Application Laid-Open No. 2014-197175).

As the width of a sheet on which an image is to be formed increases, the length of a maximum image region, where an image is formable on the image bearing member, in the longer-side direction thereof increases, so that the length of a surface (coating amount regulating surface), which regulates the amount of the developer borne on the developer bearing member, of the regulating blade in the longer-side direction increases. Thus, as the width of a sheet on which an image is to be formed increases, the length of a region (hereinafter, referred to as "maximum image region of the regulating blade") of the regulating blade in the longer-side direction that corresponds to the maximum image region of the image bearing member increases. In a case of resin-molding a regulating blade that is long in the longer-side direction, the rate of thermal contraction of the resin that is thermally expanded often varies in the longer-side direction of the regulating blade. Thus, in a case in which a regulating blade that is long in the longer-side direction is resin-molded with a normal accuracy of a resin-molded article, it is difficult to guarantee the straightness of a coating amount regulating surface of the resin-molded regulating blade.

Thus, in the case of the regulating blade made of resin, the longer the coating amount regulating surface is in the longer-side direction, the more the SB gap is likely to vary significantly in the longer-side direction of the developer bearing member due to the straightness of the coating amount regulating surface. If the SB gap varies in the longer-side direction of the developer bearing member, the coating amount of the developer can vary in the longer-side direction of the developer bearing member. Thus, in the development apparatus including the regulating blade made of resin, the SB gap needs to be within a predetermined range along the longer-side direction of the developer bearing member regardless of the straightness of the coating amount regulating surface, and a force for warping the regulating blade needs to be exerted on the regulating blade.

Thus, the resin regulating blade is warped in such a way that the SB gap is within the predetermined range along the longer-side direction of the developer bearing member, and the regulating blade in the warped state is fixed to a portion (hereinafter, referred to as "blade attachment portion") to which the regulating blade of the development frame is to be fixed. At this time, in order to prevent the regulating blade from returning from the warped state to the original state, it is desirable to fix the regulating blade in the warped state across an entire region (hereinafter, referred to as "maximum image region of the blade attachment portion") of the blade attachment portion that corresponds to the maximum image region of the image bearing member. This is because, if the regulating blade in the warped state is fixed to the blade attachment portion and thereafter returned from the warped state to the original state, the SB gap varies in the longer-side direction of the developer bearing member regardless of the SB gap adjusted to be within the predetermined range across the longer-side direction of the developer bearing member.

Thus, in the development apparatus including the regulating blade made of resin and the development frame made of resin, it is desirable to fix the regulating blade in the warped state across the entire maximum image region of the blade attachment portion. A possible method for fixing the regulating blade in the warped state across the entire maximum image region of the blade attachment portion is to use an adhesive. For example, an adhesive having a predetermined layer thickness is applied to a surface (blade attachment surface) of the blade attachment portion that is a surface to which the regulating blade is to be attached. In order to fix the regulating blade in the warped state across the entire maximum image region of the blade attachment portion using an adhesive, the adhesive needs to be applied across the entire maximum image region of the blade attachment surface.

With a normal accuracy of an adhesive application apparatus configured to apply an adhesive to a blade attachment surface by moving an adhesive application unit in the longer-side direction, the layer thickness of the adhesive applied to the blade attachment surface by the adhesive application apparatus varies in the longer-side direction of the blade attachment surface.

As described above, as the width of a sheet on which an image is to be formed increases, the length of the regulating blade in the longer-side direction of the maximum image region increases, so that the length of the blade attachment surface in the longer-side direction of the maximum image region to which the regulating blade which extends in the longer-side direction is to be attached also increases. Further, the longer the length of the blade attachment surface in the longer-side direction of the maximum image region is, the more the layer thickness of the adhesive applied to the blade attachment surface by the adhesive application apparatus is likely to vary significantly in the longer-side direction of the blade attachment surface.

The length of time (hereinafter, referred to simply as "adhesive hardening time") needed to harden the adhesive so as to obtain a sufficient bonding strength of the regulating blade with respect to the blade attachment surface is proportional to the layer thickness of the adhesive. Specifically, the thicker the layer thickness of the adhesive is, the longer the adhesive hardening time becomes, and the thinner the layer thickness of the adhesive is, the shorter the adhesive hardening time becomes. Thus, if the layer thickness of the adhesive applied to the blade attachment surface varies in the longer-side direction of the blade attachment surface, hardening time of the adhesive applied to the blade attachment surface varies in the longer-side direction of the blade attachment surface. Especially in the case in which the adhesive application apparatus applies the adhesive to the entire maximum image region to which the regulating blade which extends in the longer-side direction is to be attached, the degree of variation in the adhesive hardening time is more likely to be significant in the longer-side direction of the blade attachment surface.

If the adhesive hardening time varies significantly in the longer-side direction of the blade attachment surface, when a predetermined time passes after the adhesive is applied, the adhesive is sufficiently hardened at some portions and is not sufficiently hardened at some other portions in the longer-side direction of the blade attachment surface. In the case in which the adhesive is sufficiently hardened at some portions and is not sufficiently hardened at some other portions in the longer-side direction of the blade attachment surface, the length of time to be spent in the bonding step in a process of manufacturing the development apparatus needs to be set according to the portions at which the adhesive is not sufficiently hardened. Specifically, when the predetermined time passes after the adhesive is applied, even if the adhesive is sufficiently hardened at a portion in the longer-side direction of the blade attachment surface, as long as there is another portion at which the adhesive is not sufficiently hardened, it is needed to wait until the adhesive at the portion at which the adhesive is not sufficiently hardened is sufficiently hardened. Thus, a possible variation in the layer thickness of the adhesive to be applied to the blade attachment surface by the adhesive application apparatus is estimated in advance, and the length of time to be spent in bonding in the process of manufacturing the development apparatus is set.

From the point of view of mass production, a time spent in the bonding step in the process of manufacturing the development apparatus is desirably short, and an adhesive hardening time in the bonding step is also desirably short. This is because, if the adhesive hardening time is reduced, the takt time can be reduced, which is advantageous from the point of view of mass production. As described above, the adhesive hardening time is determined based on the layer thickness of the applied adhesive (specifically, the amount of the applied adhesive). Thus, the amount of the adhesive to be applied to the blade attachment surface by the adhesive application apparatus during the bonding step is set as described below. Specifically, in order to prevent the regulating blade from being deformed by application of an agent pressure, generated by the flow of the developer, to the regulating blade during an image forming operation, the bonding force of the regulating blade with respect to the blade attachment surface needs to be sufficiently higher than the agent pressure. Thus, the force of striping the regulating blade off the blade attachment surface due to the agent pressure and the bonding power of an adhesive using a commonly-used adhesive material are taken into consideration, and the amount of the adhesive to be applied to the blade attachment surface by the adhesive application apparatus is set to an appropriate amount.

Then, how to prevent such a variation in the adhesive hardening time that is caused by a variation in the layer thickness of the adhesive applied to the blade attachment surface is considered in the case of using a commonly-used adhesive material as the adhesive and setting the amount of the adhesive to be applied to the blade attachment surface to an appropriate amount. As to the variation in the adhesive hardening time, the longer the adhesive hardening time is, the more significant the variation in the adhesive hardening time becomes, and the shorter the adhesive hardening time is, the less significant the variation in the adhesive hardening time becomes. Thus, in order to reduce the degree of variation in the adhesive hardening time, a hardening accelerator for accelerating the hardening of an adhesive applied to fix a resin doctor blade that extends in the longer-side direction thereof to the blade attachment portion may be applied to accelerate the hardening of the adhesive.

SUMMARY OF THE INVENTION

The present disclosure is directed to a technique for reducing the length of time needed to bond a regulating blade made of resin to a development frame made of resin.

According to an aspect of the present disclosure, a method of attaching a regulating blade made of resin to an attachment portion of a development frame which is made of resin and includes the attachment portion for attaching the regulating blade includes a first application step of applying an adhesive to the attachment portion, a second application step of applying a hardening accelerator to the regulating blade, and an attaching step of attaching the regulating blade to the attachment portion via the adhesive applied to the attachment portion in the first application step and the hardening accelerator applied to the regulating blade in the second application step. The regulating blade is disposed opposite to and not in contact with a development rotary member configured to bear and convey a developer toward a position at which an electrostatic image formed on an image bearing member is developed, and configured to regulate an amount of the developer to be borne on the development rotary member.

According to another aspect of the present disclosure, a method of attaching a regulating blade made of resin to an attachment portion of a development frame which is made of resin and includes the attachment portion for attaching the regulating blade includes a first application step of applying an adhesive to the regulating blade, a second application step of applying a hardening accelerator to the attachment portion, and an attaching step of attaching the regulating blade to the attachment portion via the adhesive applied to the regulating blade in the first application step and the hardening accelerator applied to the attachment portion in the second application step. The regulating blade is disposed opposite to and not in contact with a development rotary member configured to bear and convey a developer toward a position at which an electrostatic image formed on an image bearing member is developed, and configured to regulate an amount of the developer to be borne on the development rotary member.

According to yet another aspect of the present disclosure, a development apparatus includes a development rotary member configured to bear and convey a developer toward a position at which an electrostatic image formed on an image bearing member is developed, a regulating blade made of resin and disposed opposite to and not in contact with the development rotary member, and a development frame made of resin and including an attachment portion for attaching the regulating blade. The regulating blade is configured to regulate an amount of the developer to be borne on the development rotary member. The regulating blade is bonded to the attachment portion through an adhesive and a hardening accelerator.

Further features of the present disclosure will become apparent from the following description of exemplary embodiments with reference to the attached drawings.

DESCRIPTION OF THE EMBODIMENTS

Various exemplary embodiments of the present disclosure will be described in detail below with reference to the attached drawings. It should be noted that the exemplary embodiments described below are not intended to limit the scope of the claimed disclosure and not every combination of features described in a first exemplary embodiment is always essential to a technical solution of the disclosure. The present disclosure is applicable to various uses such as printers, various printing machines, copying machines, fax machines, and multi-function peripherals.

(Structure of Image Forming Apparatus)

Figure 1:
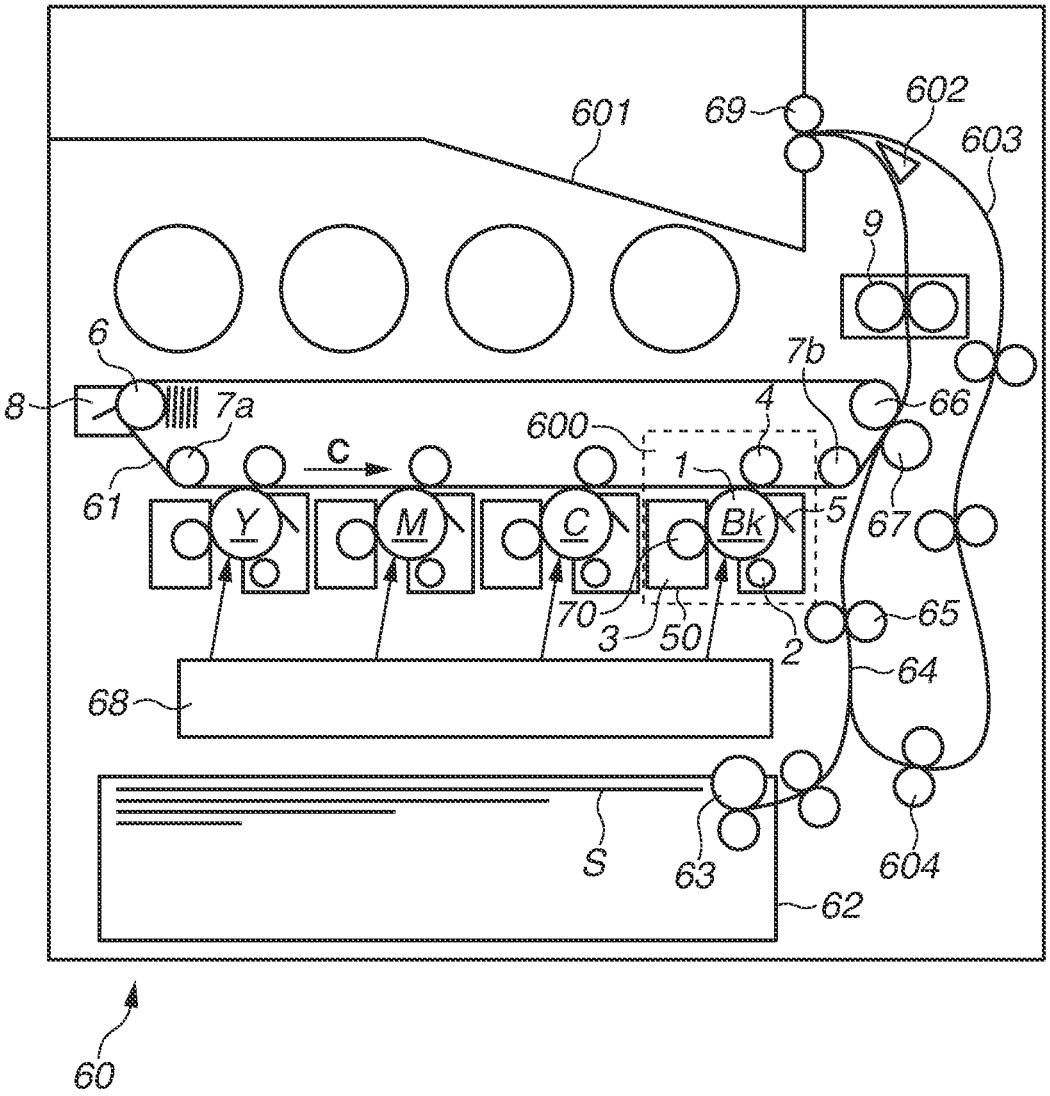
FIG. 1 is a cross-sectional view illustrating a structure of an image forming apparatus.

First, a structure of an image forming apparatus according to the first exemplary embodiment of the present disclosure will be described below with reference to a cross-sectional view illustrated in FIG. 1. As illustrated in FIG. 1, an image forming apparatus 60 includes an endless intermediate transfer belt (ITB) 61 as an intermediate transfer member and four image forming units 600 provided from an upstream side toward a downstream side along a rotation direction (direction of arrow C in FIG. 1) of the ITB 61. The four image forming units 600 respectively form yellow (Y), magenta (M), cyan (C), and black (Bk) toner images.

Each of the image forming units 600 includes a photosensitive drum 1 as an image bearing member which is rotatable. Further, the image forming unit 600 includes a charging roller 2 as a charging unit, a development apparatus 3 as a development unit, a primary transfer roller 4 as a primary transfer unit, and a photosensitive member cleaner 5 as a photosensitive member cleaning unit. The charging roller 2, the development apparatus 3, the primary transfer roller 4, and the photosensitive member cleaner 5 are disposed along the rotation direction of the photosensitive drum 1.

Each development apparatus 3 is removable from and attachable to the image forming apparatus 60. Each development apparatus 3 includes a development container 50 which stores a two-component developer (hereinafter, referred to simply as "developer") containing a non-magnetic toner (hereinafter, referred to simply as "toner") and a magnetic carrier. Further, toner cartridges respectively storing Y, M, C, and Bk toners are each removable from and attachable to the image forming apparatus 60. The Y, M, C, and Bk toners are supplied to the respective development containers 50 through toner conveyance paths. Details of the development apparatuses 3 will be described below with reference to FIGS. 2 to 4, and details of the development containers 50 will be described below with reference to FIG. 5.

The ITB 61 is stretched by a tension roller 6, a follower roller 7*a*, the primary transfer roller 4, a follower roller 7*b*, and an internal secondary transfer roller 66 and is driven and conveyed in the direction of the arrow C in FIG. 1. The internal secondary transfer roller 66 also serves as a driving roller that drives the ITB 61. As the internal secondary transfer roller 66 is rotated, the ITB 61 is rotated in the direction of the arrow C in FIG. 1.

The ITB 61 is pressed by the primary transfer roller 4 from the rear surface side of the ITB 61. Further, the ITB 61 is brought into contact with the photosensitive drum 1 to thereby form a primary transfer nip portion as a primary transfer portion between the photosensitive drum 1 and the ITB 61.

An intermediate transfer member cleaner 8 as a belt cleaning unit is in contact with the ITB 61 at a position opposite to the tension roller 6 via the ITB 61. Further, an external secondary transfer roller 67 as a secondary transfer unit is disposed at a position opposite to the internal secondary transfer roller 66 via the ITB 61. The ITB 61 is sandwiched between the internal secondary transfer roller 66 and the external secondary transfer roller 67. In this way, a secondary transfer nip portion as a secondary transfer portion is formed between the external secondary transfer roller 67 and the ITB 61. In the secondary transfer nip portion, a predetermined pressing force and transfer bias (electrostatic load bias) are applied so that a toner image is adsorbed onto a surface of a sheet S (e.g., sheet, film).

The sheet S is stored in a stacked state in a sheet storage unit 62 (e.g., sheet feeding cassette, sheet feeding deck). A sheet feeding unit 63 feeds the sheet S in synchronization with an image forming timing using, for example, a friction separation method using a sheet feeding roller. The sheet S fed by the sheet feeding unit 63 is conveyed to a registration roller 65 disposed at a position on a conveyance path 64. After skew correction and timing correction on the sheet S at the registration roller 65, the sheet S is conveyed to the secondary transfer nip portion. In the secondary transfer nip portion, the timings of the sheet S and the toner image are synchronized, and the secondary transfer is performed.

A fixing apparatus 9 is disposed downstream of the secondary transfer nip portion in the conveyance direction of the sheet S. A predetermined pressure and a predetermined amount of heat are applied from the fixing apparatus 9 to the sheet S conveyed to the fixing apparatus 9 so that the toner image is melted and fixed onto the surface of the sheet S. The sheet S with the image fixed as described above is discharged directly onto a sheet discharge tray 601 by forward rotation of a sheet discharge roller 69.

In a case of performing two-sided image forming, after the trailing edge of the sheet S passes through a switching member 602 by forward rotation of the sheet discharge roller 69, the sheet discharge roller 69 is rotated backward. In this way, the sheet S is conveyed to a two-sided conveyance path 603 with the leading and trailing edges switched. Thereafter, the sheet S is conveyed again to the conveyance path 64 by a sheet re-feeding roller 604 in synchronization with the next image forming timing.

(Image Forming Process)

In image forming, the photosensitive drum 1 is driven and rotated by a motor. The charging roller 2 uniformly charges, in advance, a surface of the photosensitive drum 1 which is driven and rotated. An exposure apparatus 68 forms an electrostatic latent image on the surface of the photosensitive drum 1 charged by the charging roller 2 based on a signal of image information input to the image forming apparatus 60. The photosensitive drum 1 forms a plurality of sizes of electrostatic latent images.

The development apparatus 3 includes a development sleeve 70 (development rotary member) as a developer bearing member which is rotatable and bears the developer. The development apparatus 3 develops the electrostatic latent image formed on the surface of the photosensitive drum 1 using the developer borne on the development sleeve 70. In this way, the toner adheres to an exposure portion on the surface of the photosensitive drum 1 to thereby visualize the image. A transfer bias (electrostatic load bias) is applied to the primary transfer roller 4, and the toner image formed on the surface of the photosensitive drum 1 is transferred onto the ITB 61. The toner (untransferred toner) that slightly remains on the surface of the photosensitive drum 1 after the primary transfer is collected by the photosensitive member cleaner 5 to prepare for the next image forming process.

The processes of forming Y, M, C, and Bk images are performed in parallel by the respective image forming units 600 at respective timings of sequentially superimposing each image on the upstream color toner image which is primarily transferred onto the ITB 61. Consequently, a full-color toner image is formed on the ITB 61, and the toner image is conveyed to the secondary transfer nip portion. A transfer bias is applied to the external secondary transfer roller 67, and the toner image formed on the ITB 61 is transferred onto the sheet S conveyed to the secondary transfer nip portion. The toner (untransferred toner) that slightly remains on the ITB 61 after the sheet S passes through the secondary transfer nip portion is collected by the intermediate transfer member cleaner 8. The fixing apparatus 9 fixes the transferred toner image to the sheet S. The sheet S onto which the toner image is fixed by the fixing apparatus 9 is discharged onto the sheet discharge tray 601.

The series of image forming processes described above is ended, and the image forming apparatus 60 prepares for the next image forming operation.

(Structure of Development Apparatus)

Figure 2:
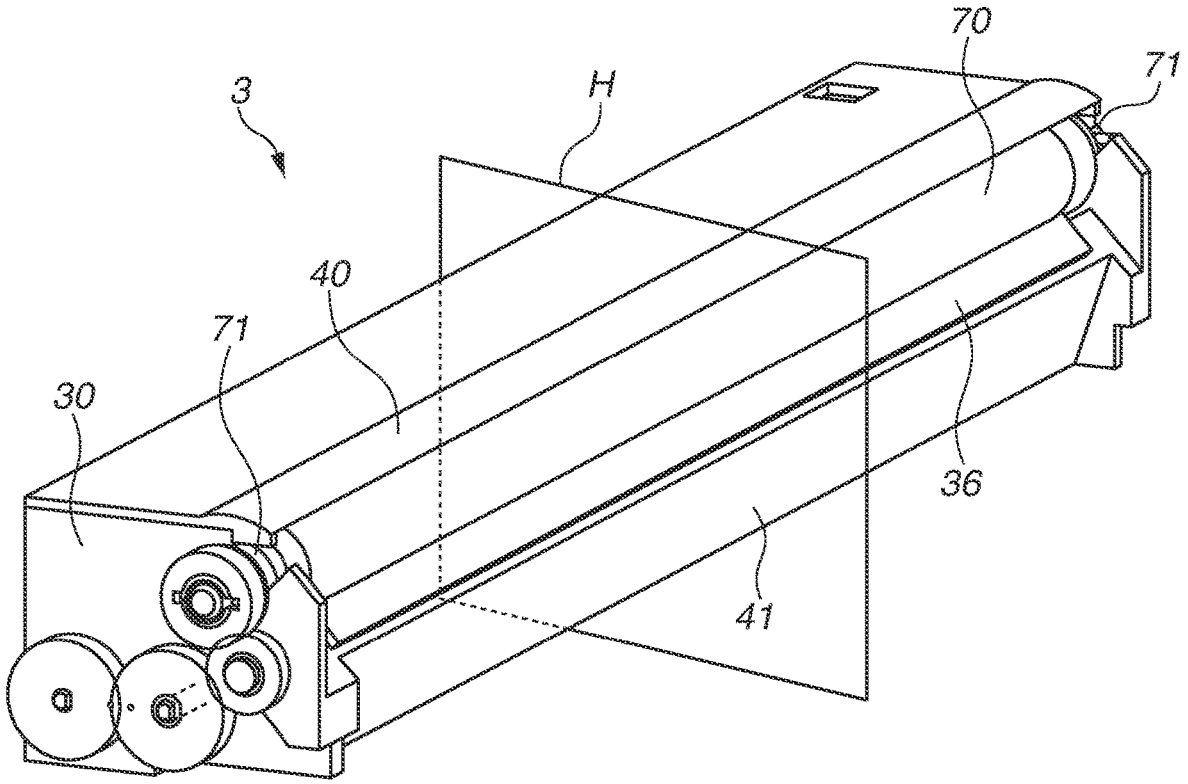
FIG. 2 is a perspective view illustrating a structure of a development apparatus according to a first exemplary embodiment.
Figure 3:
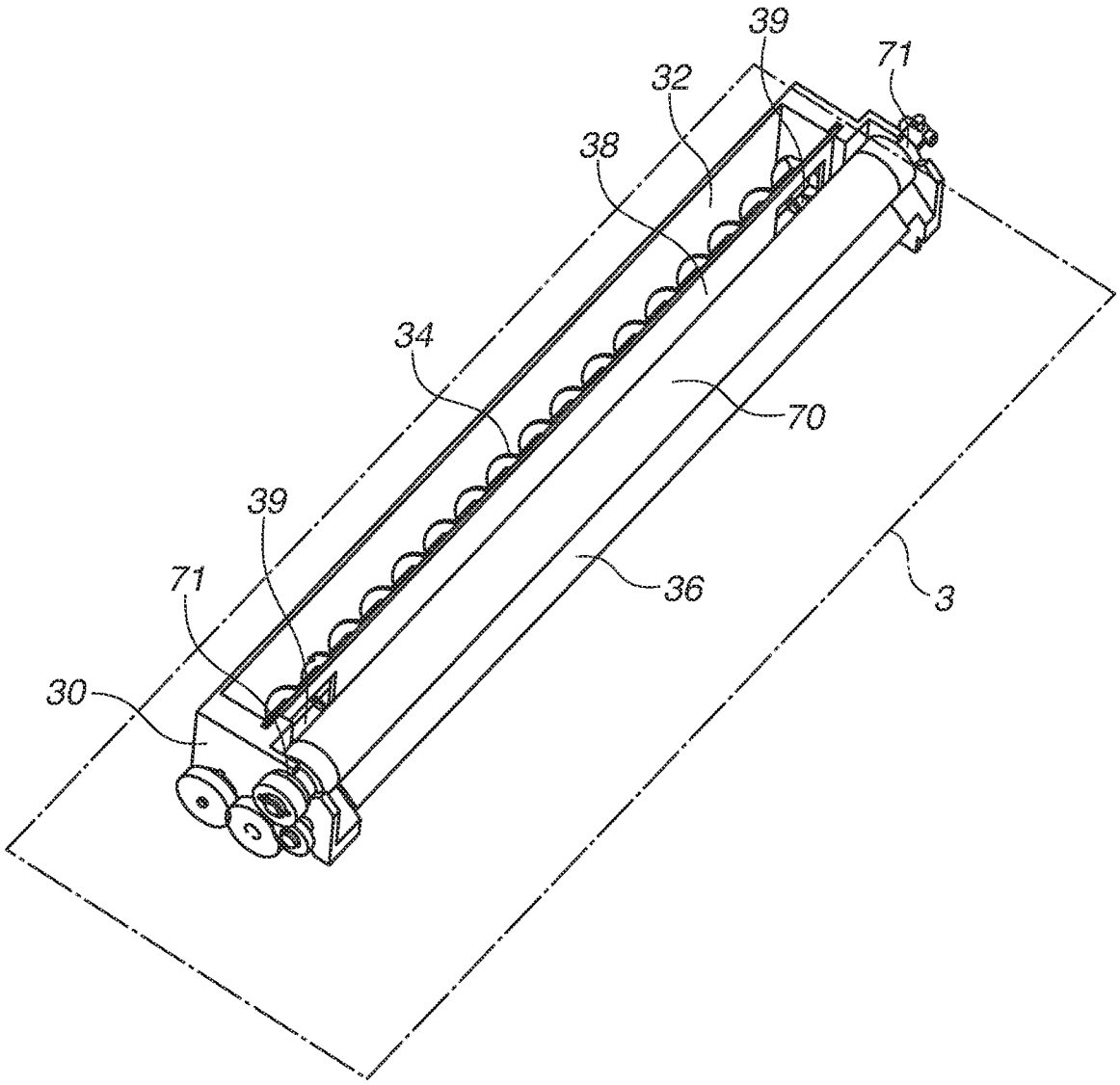
FIG. 3 is a perspective view illustrating a structure of the development apparatus according to the first exemplary embodiment.
Figure 4:
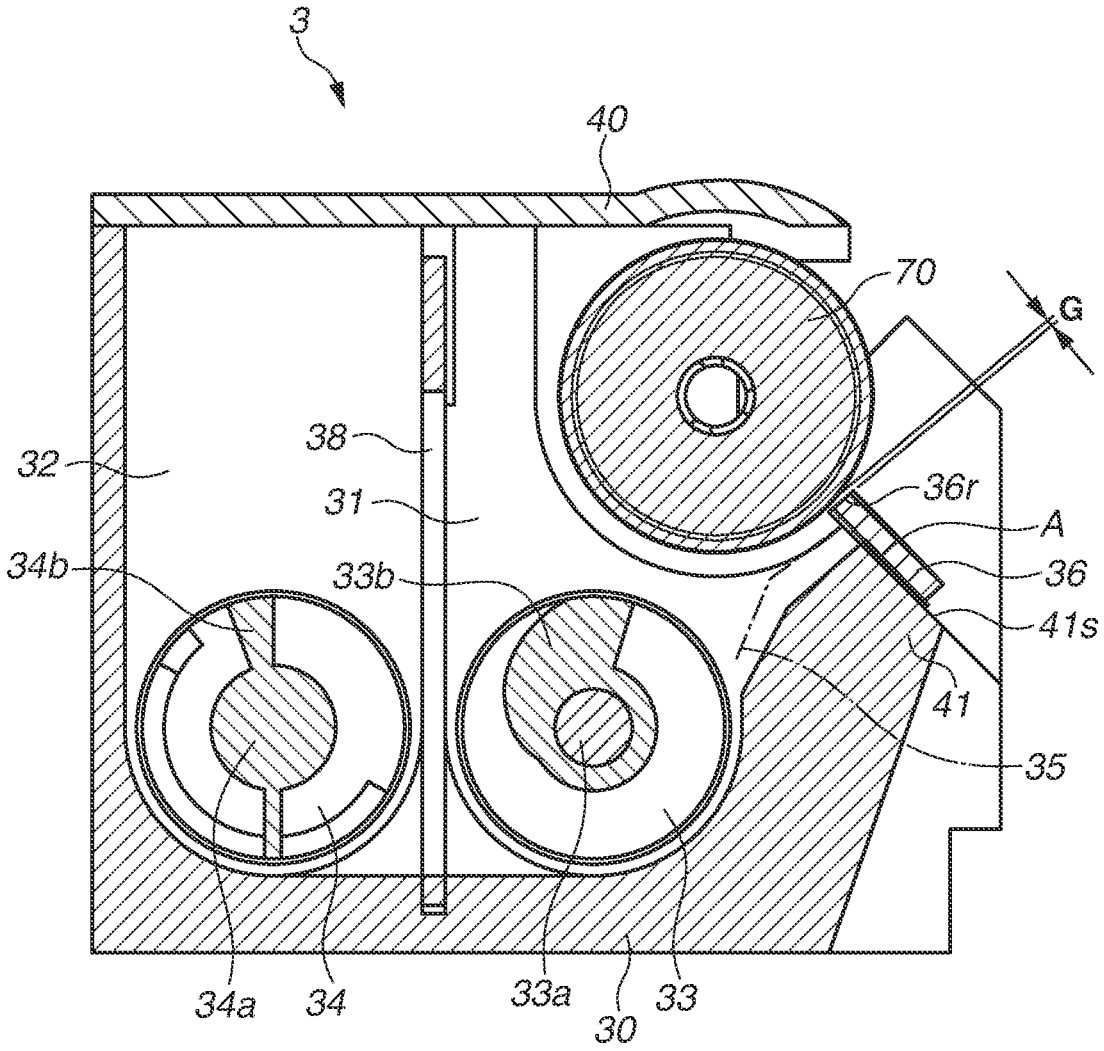
FIG. 4 is a cross-sectional view illustrating a structure of the development apparatus according to the first exemplary embodiment.

Next, a structure of the development apparatus 3 according to the first exemplary embodiment of the present disclosure will be described below with reference to perspective views in FIGS. 2 and 3 and a cross-sectional view in FIG. 4. FIG. 4 is a cross-sectional view illustrating the development apparatus 3 along a cross-section H specified in FIG. 2.

The development apparatus 3 includes the development container 50, and the development container 50 includes a development frame molded from and made of resin (hereinafter, referred to simply as "development frame 30") and a cover frame (hereinafter, referred to simply as "cover frame 40") which is formed separately from the development frame 30 and is molded from and made of resin. FIGS. 2 and 4 illustrate a state in which the cover frame 40 is attached to the development frame 30, whereas FIG. 3 illustrates a state in which the cover frame 40 is not attached to the development frame 30. Details of the structure of the development frame 30 (single item) will be described below with reference to FIG. 6.

The development container 50 includes an opening formed at a position corresponding to the development region where the development sleeve 70 faces the photosensitive drum 1. The development sleeve 70 is rotatably disposed with respect to the development container 50 so as to expose part of the development sleeve 70 from the opening of the development container 50. Each end portion of the development sleeve 70 is provided with a bearing 71 which is a bearing member.

The inside of the development container 50 is divided (partitioned) into a development chamber 31 as a first chamber and an agitation chamber 32 as a second chamber by a partition wall 38 extending in a vertical direction. The development chamber 31 and agitation chamber 32 are connected to each other at respective ends in the longer-side direction through two communication portions 39 of the partition wall 38. Thus, the developer can pass between the development chamber 31 and the agitation chamber 32 through the communication portions 39. The development chamber 31 and the agitation chamber 32 are arranged next to each other in the horizontal direction.

In the development sleeve 70 is provided and fixed a magnet roll as a magnetic field generation unit which includes a plurality of magnetic poles along the rotation direction of the development sleeve 70 and generates a magnetic field for causing the developer to be borne on the surface of the development sleeve 70. The developer in the development chamber 31 is drawn and supplied to the development sleeve 70 due to the effect of the magnetic field generated by the magnetic poles of the magnet roll. In this way, the developer is supplied from the development chamber 31 to the development sleeve 70, so that the development chamber 31 is also referred to as a supply chamber.

In the development chamber 31, a first conveyance screw 33 is provided opposite to the development sleeve 70. The first conveyance screw 33 is a conveyance unit which agitates and conveys the developer in the development chamber 31. The first conveyance screw 33 includes a rotary shaft 33*a* and a blade portion 33*b* and is rotatably supported with respect to the development container 50. The rotary shaft 33*a* is a rotatable shaft portion, and the blade portion 33*b* is a spiral developer conveyance portion provided along the outer periphery of the rotary shaft 33*a*. Each end portion of the rotary shaft 33*a* is provided with a bearing member.

Further, a second conveyance screw 34 as a conveyance unit is provided in the agitation chamber 32. The second conveyance screw 34 agitates the developer in the agitation chamber 32 and conveys the developer in an opposite direction to the first conveyance screw 33. The second conveyance screw 34 includes a rotary shaft 34*a* and a blade portion 34*b* and is rotatably supported with respect to the development container 50. The rotary shaft 34*a* is a rotatable shaft portion, and the blade portion 34*b* is a spiral developer conveyance portion provided along the outer periphery of the rotary shaft 34*a*. Each end portion of the rotary shaft 34*a* is provided with a bearing member. Further, the first conveyance screw 33 and the second conveyance screw 34 are driven and rotated so that a circulation path through which the developer is circulated through the communication portions 39 is formed between the development chamber 31 and the agitation chamber 32.

In the development container 50, a regulating blade (hereinafter, referred to as "doctor blade 36") as a developer regulating member is attached opposite to and not in contact with the surface of the development sleeve 70. The doctor blade 36 regulates the amount (also referred to as "developer coating amount") of the developer borne on the surface of the development sleeve 70. The doctor blade 36 includes a coating amount regulating surface 36*r* as a regulating portion which regulates the amount of the developer borne on the surface of the development sleeve 70. The doctor blade 36 is molded from and made of resin. A structure of the doctor blade 36 (single item) will be described below with reference to FIG. 5.

The doctor blade 36 is disposed opposite to the development sleeve 70 with a predetermined gap, i.e., a sleeve-to-blade gap G (hereinafter, referred to as "SB gap G") between the doctor blade 36 and the development sleeve 70 along a longer-side direction (specifically, direction parallel to a rotation axis of the development sleeve 70) of the development sleeve 70. In the present exemplary embodiment, the SB gap G refers to the shortest distance between a maximum image region of the development sleeve 70 and a maximum image region of the doctor blade 36. The maximum image region of the development sleeve 70 refers to a region (i.e., the maximum image region of the development sleeve 70) of the development sleeve 70 that corresponds to a maximum image region where an image is formable on the surface of the photosensitive drum 1 with respect to the direction of the rotation axis of the development sleeve 70. Further, the maximum image region of the doctor blade 36 refers to a region (i.e., the maximum image region of the doctor blade 36) of the doctor blade 36 that corresponds to a maximum image region of the photosensitive drum 1 with respect to the direction parallel to the rotation axis of the development sleeve 70. In the first exemplary embodiment, the photosensitive drum 1 forms electrostatic latent images having a plurality of sizes, so that the maximum image region refers to the image region that corresponds to the largest size (e.g., A3 size) among the image regions of the plurality of sizes formable on the photosensitive drum 1. On the other hand, in a modification example in which the photosensitive drum 1 only forms a single size of an electrostatic latent image, the maximum image region refers to the image region of the single size formable on the photosensitive drum 1.

The doctor blade 36 is disposed substantially opposite to a peak position of the magnetic flux density of the magnetic poles of the magnet roll. The developer that is supplied to the development sleeve 70 is affected by the magnetic field generated by the magnetic poles of the magnet roll. Further, the developer that is regulated and removed by the doctor blade 36 is likely to accumulate in an upstream portion of the SB gap G. Consequently, a developer pool is formed upstream of the doctor blade 36 in the rotation direction of the development sleeve 70. Then, a portion of the developer in the developer pool is conveyed so as to pass through the SB gap G as the development sleeve 70 is rotated. At this time, the layer thickness of the developer that passes through the SB gap G is regulated by the coating amount regulating surface 36*r* of the doctor blade 36. In this way, a thin layer of the developer is formed on the surface of the development sleeve 70.

Then, a predetermined amount of the developer borne on the surface of the development sleeve 70 is conveyed to the development region as the development sleeve 70 is rotated. Thus, the amount of the developer conveyed to the development region is adjusted by adjusting the size of the SB gap G. In the first exemplary embodiment, a target size of the SB gap G (i.e., target value of the SB gap G) in the adjustment of the size of the SB gap G is set to about 300 μm.

The developer conveyed to the development region is magnetically raised in the development region to thereby form a magnetic brush. The magnetic brush is brought into contact with the photosensitive drum 1 to thereby supply the toner contained in the developer to the photosensitive drum 1. Then, the electrostatic latent image formed on the surface of the photosensitive drum 1 is developed as a toner image. The developer (hereinafter, referred to as "the developer after the development step") on the surface of the development sleeve 70 after the developer passes through the development region and the toner is supplied to the photosensitive drum 1 is removed from the surface of the development sleeve 70 by a repulsive magnetic field formed between the magnetic poles of the magnet roll that have the same polarity. The developer after the development step that is removed from the surface of the development sleeve 70 falls into the development chamber 31 and is thereby collected in the development chamber 31.

As illustrated in FIG. 4, the development frame 30 is provided with a developer guide portion 35 for guiding the developer so as to convey the developer toward the SB gap G. The developer guide portion 35 and the development frame 30 are integrally formed, whereas the developer guide portion 35 and the doctor blade 36 are separately formed. The developer guide portion 35 is formed in the development frame 30 and is arranged upstream of the coating amount regulating surface 36*r* of the doctor blade 36 in the rotation direction of the development sleeve 70. The flow of the developer is stabilized by the developer guide portion 35 and adjusted to a predetermined developer density so that the weight of the developer at a position at which the distance of the coating amount regulating surface 36*r* of the doctor blade 36 from the surface of the development sleeve 70 is minimized is determined.

Further, as illustrated in FIG. 4, the cover frame 40 is formed separately from the development frame 30 and is attached to the development frame 30. Further, the cover frame 40 covers part of an opening of the development frame 30 so as to cover part of the outer peripheral surface of the development sleeve 70 across the entire region of the development sleeve 70 in the longer-side direction of the development sleeve 70. At this time, the cover frame 40 covers part of the opening of the development frame 30 so as to expose the development region of the development sleeve 70 which faces the photosensitive drum 1. The cover frame 40 is fixed to the development frame 30 by ultrasonic bonding. Alternatively, the cover frame 40 can be fixed to the development frame 30 by screw fastening, snap-fit, bonding, or welding.

(Structure of Doctor Blade Made of Resin)

A structure of the doctor blade 36 (single item) will be described below with reference to a perspective view illustrated in FIG. 5.

During the image forming operation (development operation), the pressure (hereinafter, referred to as "agent pressure") of the developer that is generated by the flow of the developer is applied to the doctor blade 36. As the rigidity of the doctor blade 36 is lower, the doctor blade 36 is more likely to be deformed when the agent pressure is applied to the doctor blade 36 during the image forming operation, and the size of the SB gap G is more likely to fluctuate. During the image forming operation, the agent pressure is applied in a shorter-side direction (direction of arrow M in FIG. 5) of the doctor blade 36. Thus, in order to prevent a fluctuation in the size of the SB gap G during the image forming operation, it is desirable to increase the rigidity of the doctor blade 36 in the shorter-side direction so that the doctor blade 36 is reinforced against a deformation in the shorter-side direction.

Figure 5:
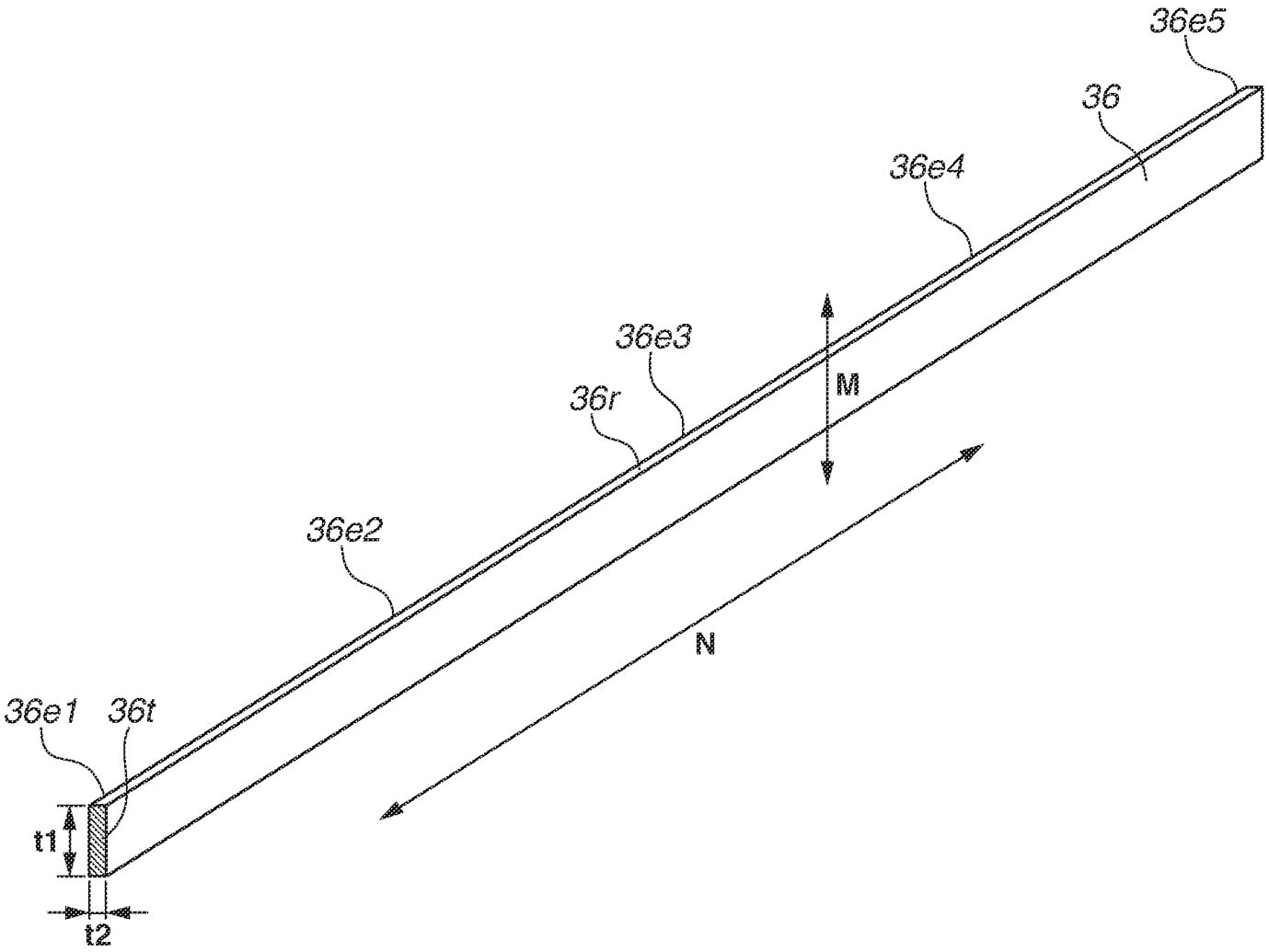
FIG. 5 is a perspective view illustrating a structure of a doctor blade (single item) made of resin.

As illustrated in FIG. 5, the shape of the doctor blade 36 is plate-shaped from the point of view of mass production and cost. Further, as illustrated in FIG. 5, the cross-sectional area of a side surface 36*t* of the doctor blade 36 is set to be small, and a length $t_2$ of the doctor blade 36 in the thickness direction of the doctor blade 36 is set to be smaller than a length $t_1$ of the doctor blade 36 in the shorter-side direction of the doctor blade 36. This enables the doctor blade 36 (single item) to be deformable with respect to a direction (direction of arrow M in FIG. 5) that is orthogonal to the longer-side direction (direction of arrow N in FIG. 5) of the doctor blade 36. Thus, in order to correct the straightness of the coating amount regulating surface 36*r*, the doctor blade 36 is fixed to a blade attachment portion 41 of the development frame 30 in a state that at least part of the doctor blade 36 is warped in the direction of the arrow M in FIG. 5. Details of the correction of the straightness of the doctor blade 36 will be described below with reference to FIG. 9.

(Structure of Development Frame Made of Resin)

Figure 6:
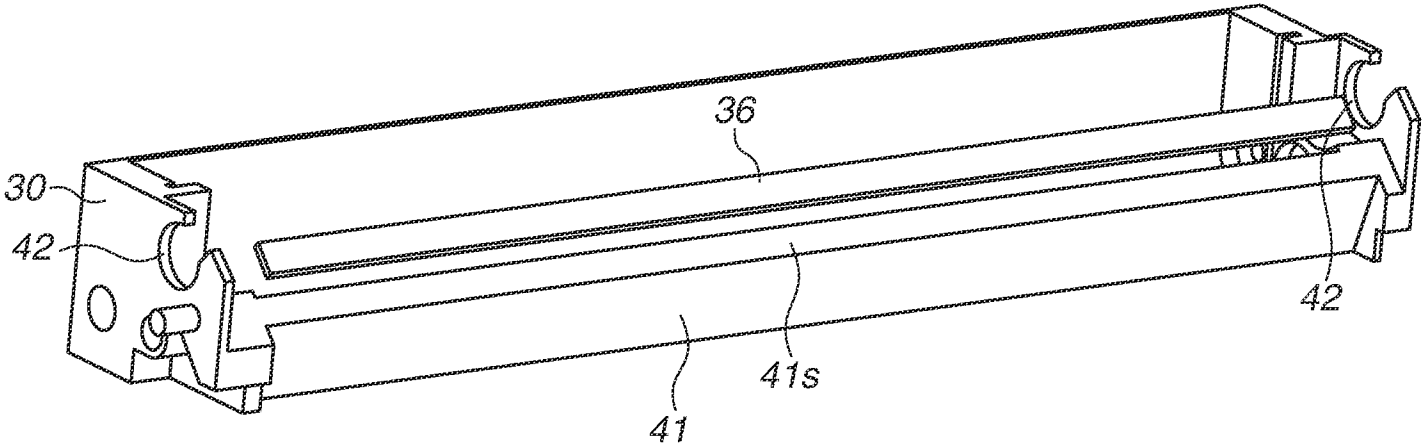
FIG. 6 is a perspective view illustrating a structure of a development frame (single item) made of resin.

A structure of the development frame 30 (single item) will be described below with reference to a perspective view illustrated in FIG. 6. FIG. 6 illustrates a state in which the cover frame 40 is not attached to the development frame 30.

The development frame 30 includes the development chamber 31 and the agitation chamber 32 divided from the development chamber 31 by the partition wall 38. The partition wall 38 is resin-molded and can be formed either separately from the development frame 30 or integrally with the development frame 30.

The development frame 30 includes a sleeve support portions 42 for rotatably supporting the development sleeve 70 by supporting the bearings 71 provided to the respective end portions of the development sleeve 70. Further, the development frame 30 includes the blade attachment portion 41 for attaching the doctor blade 36, and the blade attachment portion 41 is formed integrally with the sleeve support portion 42. FIG. 6 illustrates a virtual state in which the doctor blade 36 is in the air, apart from the blade attachment portion 41.

In a state that the doctor blade 36 is attached to the blade attachment portion 41, an adhesive A applied to a blade attachment surface 41*s* of the blade attachment portion 41 is hardened so that the doctor blade 36 is fixed to the blade attachment portion 41. Details of the steps of a method of bonding the doctor blade 36 according to the first exemplary embodiment will be described below with reference to FIGS. 14, 16, and 17.

(Rigidity of Doctor Blade Made of Resin)

The rigidity of the doctor blade 36 (single item) will be described below with reference to a schematic view illustrated in FIG. 7. The rigidity of the doctor blade 36 (single item) is measured in a state that the doctor blade 36 is not fixed to the blade attachment portion 41 of the development frame 30.

Figure 7:
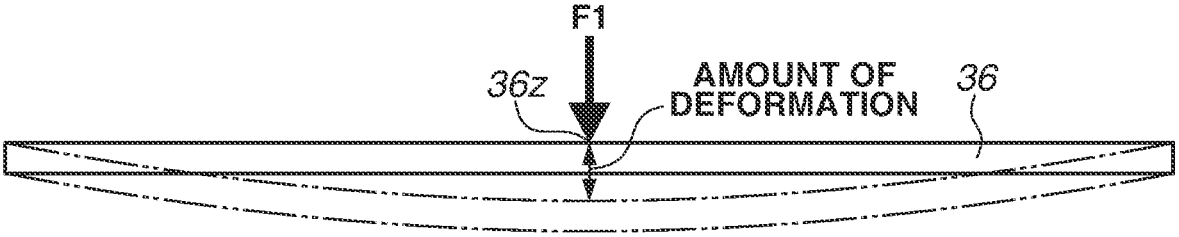
FIG. 7 is a schematic view illustrating the rigidity of the doctor blade (single item) made of resin.

As illustrated in FIG. 7, a concentrated load F1 is applied in the shorter-side direction of the doctor blade 36 with respect to a central portion 36*z* of the doctor blade 36 in the longer-side direction of the doctor blade 36. At this time, the rigidity of the doctor blade 36 (single item) is measured based on the amount of a warp at the central portion 36*z* of the doctor blade 36 in the shorter-side direction of the doctor blade 36.

For example, a concentrated load F1 of 300 gf is applied in the shorter-side direction of the doctor blade 36 with respect to the central portion 36*z* of the doctor blade 36 in the longer-side direction of the doctor blade 36. At this time, the amount of the warp at the central portion 36*z* of the doctor blade 36 in the shorter-side direction of the doctor blade 36 is 700 μm or more, and the amount of deformation of the central portion 36*z* of the doctor blade 36 on the cross section is 5 μm or less.

(Rigidity of Development Frame Made of Resin)

The rigidity of the development frame 30 (single item) will be described below with reference to a schematic view illustrated in FIG. 8. The rigidity of the development frame 30 (single item) is measured in a state in which the doctor blade 36 is not fixed to the blade attachment portion 41 of the development frame 30.

Figure 8:
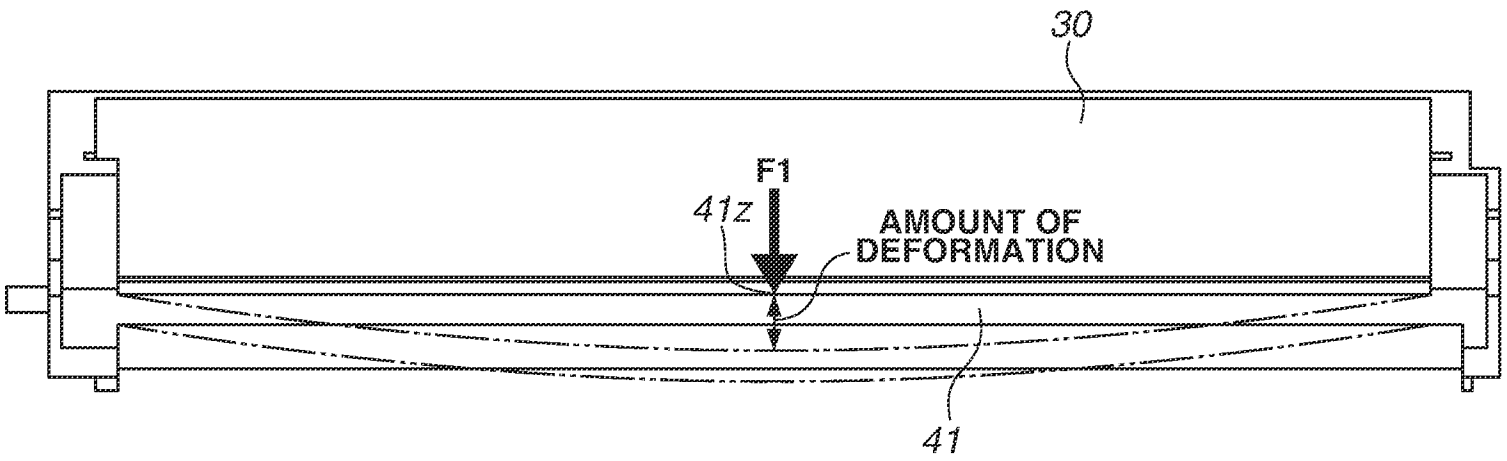
FIG. 8 is a schematic view illustrating the rigidity of the development frame (single item) made of resin.

As illustrated in FIG. 8, the concentrated load F1 is applied in a shorter-side direction of the blade attachment portion 41 with respect to a central portion 41*z* of the blade attachment portion 41 in a longer-side direction of the blade attachment portion 41. At this time, the rigidity of the development frame 30 (single item) is measured based on the amount of the warp at the central portion 41*z* of the blade attachment portion 41 in the shorter-side direction of the blade attachment portion 41.

For example, a concentrated load F1 of 300 gf is applied in the shorter-side direction of the blade attachment portion 41 with respect to the central portion 41*z* of the blade attachment portion 41 in the longer-side direction of the blade attachment portion 41. At this time, the amount of the warp at the central portion 41*z* of the blade attachment portion 41 in the shorter-side direction of the blade attachment portion 41 is 60 μm or less.

The same concentrated load F1 is applied to the central portion 36*z* of the doctor blade 36 and to the central portion 41*z* of the blade attachment portion 41 of the development frame 30. At this time, the amount of the warp at the central portion 36*z* of the doctor blade 36 is ten or more times the amount of the warp at the central portion 41*z* of the blade attachment portion 41. Thus, the rigidity of the development frame 30 (single item) is ten or more times higher than the rigidity of the doctor blade 36 (single item). Thus, in the state in which the doctor blade 36 is attached and fixed to the blade attachment portion 41 of the development frame 30, the rigidity of the development frame 30 becomes dominant with respect to the rigidity of the doctor blade 36. Further, the rigidity of the doctor blade 36 fixed to the development frame 30 is higher in the case in which the doctor blade 36 is fixed to the development frame 30 over the entire maximum image region thereof than in the case in which the doctor blade 36 is fixed to the development frame 30 only at the respective end portions of the doctor blade 36 in the longer-side direction thereof.

Further, the rigidity of the development frame 30 (single item) is higher than the rigidity of the cover frame 40 (single item). Thus, in the state in which the cover frame 40 is attached and fixed to the development frame 30, the rigidity of the development frame 30 becomes dominant with respect to the rigidity of the cover frame 40.

(Correction of Straightness of Doctor Blade Made of Resin)

As the width of the sheet S on which an image is to be formed is increased, e.g., the width of the sheet S is an A3 size, the length of the maximum image region where an image is formable on the surface of the photosensitive drum 1 increases in the direction parallel to the rotation axis of the development sleeve 70. Thus, as the width of the sheet S on which an image is to be formed is increased, the length of the maximum image region of the doctor blade 36 increases. In a case of resin-molding a doctor blade that extends in the longer-side direction, it is difficult to guarantee the straightness of a coating amount regulating surface of the resin-molded doctor blade made of resin. This is because in the case of resin-molding a doctor blade that extends in the longer-side direction, when thermally-expanded resin is thermally contracted, thermal contraction proceeds faster at some positions in the longer-side direction of the doctor blade while thermal contraction proceeds slower at some other positions in the longer-side direction of the doctor blade.

In the resin doctor blade, thus, as the length of the doctor blade in the longer-side direction becomes longer, the SB gap is more likely to vary in the longer-side direction of the developer bearing member due to the straightness of the coating amount regulating surface of the doctor blade. If the SB gap varies in the longer-side direction of the developer bearing member, the amount of the developer borne on the surface of the developer bearing member in the longer-side direction of the developer bearing member can also vary.

For example, in a case in which a resin doctor blade having the length in the longer-side direction that can support A3 size (hereinafter, referred to as "A3-size-supporting resin doctor blade") is manufactured with a common accuracy of a resin-molded article, the straightness of the coating amount regulating surface is about 300 μm to 500 μm. Further, even if the A3-size-supporting resin doctor blade is manufactured with high accuracy using a highly-accurate resin material, the straightness of the coating amount regulating surface is about 100 μm to 200 μm.

In the first exemplary embodiment, the size of the SB gap G is set to about 300 μm and the tolerance (specifically, the tolerance of the SB gap G with respect to the target value) of the SB gap G is set to ±10% or less. This indicates that in the first exemplary embodiment, the adjustment range of the SB gap G is 300 μm+30 μm and a maximum allowable tolerance of the SB gap G is up to 60 μm. Thus, regardless of whether the A3-size-supporting resin doctor blade is manufactured with common accuracy of a resin-molded article or with high accuracy using a highly-accurate resin material, the accuracy of the straightness of the coating amount regulating surface exceeds the allowable tolerance range of the SB gap G alone.

A development apparatus including a doctor blade made of resin is desired to satisfy the below-described condition. Specifically, in the state in which the doctor blade is fixed to the attachment portion of the development frame, the SB gap G is desirably within a predetermined range across the direction parallel to the rotation axis of the developer bearing member, regardless of the straightness of the coating amount regulating surface of the resin doctor blade. Thus, in the first exemplary embodiment, the straightness of the coating amount regulating surface of the resin doctor blade is corrected if the straightness is low. In this way, even if a doctor blade made of resin and including a coating amount regulating surface having a low straightness is used, in the state in which the doctor blade is fixed to an attachment portion of a development frame, the SB gap G is adjusted to be within the predetermined range across the direction parallel to the rotation axis of the development sleeve 70.

The straightness of the coating amount regulating surface **36*r* of the doctor blade 36 will be described below with reference to a schematic view illustrated in FIG. 9. The straightness of the coating amount regulating surface 36*r* is specified by the absolute value of the difference between maximum and minimum values of the outer shape of the coating amount regulating surface 36*r* using, as a reference, a predetermined portion of the coating amount regulating surface 36*r* in the longer-side direction of the coating amount regulating surface 36*r*. For example, a central portion of the coating amount regulating surface 36*r* in the longer-side direction of the coating amount regulating surface 36*r* is determined as the origin of an orthogonal coordinate system, and a predetermined straight line passing through the origin is determined as an X-axis and a straight line drawn perpendicularly to the X-axis from the origin is determined as a Y-axis. On the orthogonal coordinate system, the straightness of the coating amount regulating surface 36*r* is specified by the absolute value of the difference between maximum and minimum values of the outer shape of the coating amount regulating surface 36*r***.

Figure 9:
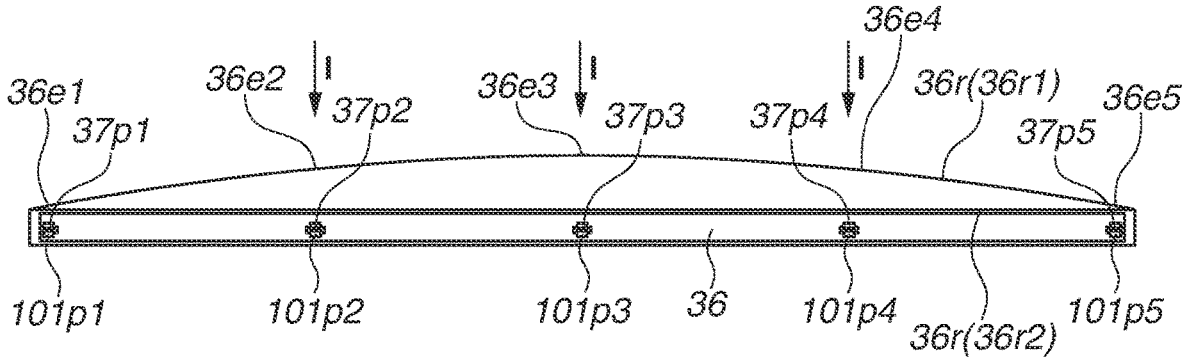
FIG. 9 is a schematic view illustrating the straightness of the doctor blade (single item) made of resin.

As illustrated in FIG. 9, the coating amount regulating surface **36*r* of the resin doctor blade 36 (single item) is significantly warped at the central portion thereof in the longer-side direction of the doctor blade 36. Thus, the straightness of the coating amount regulating surface 36*r* needs to be corrected by reducing the difference between the positions of leading edge portions 36*e* (36*e*1 to 36*e*5) of the doctor blade 36 in FIG. 5. In view of the allowable values of the tolerance of the SB gap G and the attachment accuracy of the doctor blade 36 with respect to the development frame 30, the straightness of the coating amount regulating surface 36*r* of the doctor blade 36 needs to be corrected to 50 μm or less. As the accuracy of the straightness of a doctor blade made of metal by secondary cutting is 20 μm or less, it is more desirable to correct the straightness of the coating amount regulating surface 36*r* of the resin doctor blade 36 to 20 μm or less. In view of a realistic mass production process, the setting value of the correction of the straightness of the coating amount regulating surface 36*r* of the doctor blade 36** is set to about 20 μm to 50 μm.

In order to do so, a force (also referred to as "straightness correction force") for warping at least part of the maximum image region of the doctor blade 36 is exerted on the doctor blade 36 so that at least part of the maximum image region of the doctor blade 36 is warped. In this way, the straightness of the coating amount regulating surface **36*r* of the doctor blade 36** is corrected to 50 μm or less.

In the example illustrated in FIG. 9, the outer shapes of the leading edge portions **36*e*1 and 36*e*5 of the doctor blade 36 are determined as a reference, and the straightness correction force is exerted in the direction of arrows 1 in FIG. 9 with respect to the leading edge portions 36*e*2, 36*e*3, and 36*e*4 in such a manner that the outer shapes of the leading edge portions 36*e*2, 36*e*3, and 36*e*4 are adjusted to the reference. Consequently, the shape of the coating amount regulating surface 36***r* of the doctor blade 36 is corrected from a coating amount regulating surface 36*r*1 to a coating amount regulating surface 36*r*2, so that the straightness of the coating amount regulating surface 36*r* of the doctor blade 36 is corrected to 50 μm or less. While the outer shapes of the leading edge portions 36*e*1 and 36*e*5 (the respective end portions of the coating amount regulating surface 36*r* in the longer-side direction of the coating amount regulating surface 36*r*) are determined as the reference for the adjustment of the outer shape of the leading edge portion 36*e* of the doctor blade 36 in the example illustrated in FIG. 9, the outer shape of the leading edge portion 36*e*3 (the central portion of the coating amount regulating surface 36*r* in the longer-side direction of the coating amount regulating surface 36*r*) can be determined as a reference. In this case, the outer shape of the leading edge portion 36*e*3 of the doctor blade 36 is used as a reference, and the straightness correction force is exerted on the doctor blade 36 in such a manner that the outer shapes of the leading edge portions 36*e*1, 36*e*2, 36*e*4, and 36*e*5 are adjusted to the reference.

As described above, in order to correct the straightness of the doctor blade 36, the rigidity of the doctor blade 36 (single item) needs to be reduced in such a manner that at least part of the maximum image region of the coating amount regulating surface 36*r* is warped when the straightness correction force is exerted on the doctor blade 36.

(Method of Adjusting SB Gap)

The SB gap G is adjusted by moving the position of the doctor blade 36 with respect to the development frame 30 so as to adjust the relative position of the doctor blade 36 attached to the blade attachment portion 41 with respect to the development sleeve 70 supported by the sleeve support portion 42. The doctor blade 36 with at least part of the maximum image region of the doctor blade 36 warped is fixed to the predetermined position of the blade attachment portion 41 determined through the adjustment of the SB gap G using the adhesive A applied in advance to the entire maximum image region of the blade attachment surface 41*s*.

The maximum image region of the blade attachment surface 41*s* refers to a region of the blade attachment surface 41*s* that corresponds to the maximum image region where an image is formable on the surface of the photosensitive drum 1 in the direction parallel to the rotation axis of the development sleeve 70. At this time, the region of the doctor blade 36 that is warped to correct the straightness of the coating amount regulating surface 36*r* in the maximum image region of the doctor blade 36 is fixed to the blade attachment portion 41.

In the case in which the region on which the force for warping at least part of the maximum image region of the doctor blade 36 is exerted is to be fixed to the blade attachment portion 41 using the adhesive A, the adhesive A does not need to be applied to part of the blade attachment surface 41*s*. Thus, the state in which the adhesive A is applied across the entire maximum image region of the blade attachment surface 41*s* is a state in which the following condition is satisfied. Specifically, the adhesive A is applied to 95% or more (including the region warped to correct the straightness of the coating amount regulating surface 36*r* in the region that corresponds to the maximum image region of the doctor blade 36) of the maximum image region of the blade attachment surface 41*s* at the time of attaching the doctor blade 36 to the blade attachment portion 41.

In this way, the region warped to correct the straightness of the coating amount regulating surface 36*r* in the maximum image region of the doctor blade 36 is prevented from returning from the warped state to the original state before the warp. In this way, the doctor blade 36 is fixed to the blade attachment portion 41 in the state that the straightness of the coating amount regulating surface 36*r* is corrected to 50 μm or less.

The size of the SB gap G is measured (calculated) using a method described below. The size of the SB gap G is measured in a state that the development sleeve 70 is supported by the sleeve support portion 42 of the development frame 30 and the doctor blade 36 is attached to the blade attachment portion 41 of the development frame 30 and the cover frame 40 is fixed to the development frame 30.

Prior to the measurement of the SB gap G, a light source (e.g., light emission unit such as a light-emitting diode (LED) array and light guide) is inserted into the development chamber 31 across the longer-side direction of the development chamber 31. The light source inserted in the development chamber 31 emits light from the inside of the development chamber 31 toward the SB gap G. Further, a camera (light reception unit) is disposed at each of the five positions corresponding to the leading edge portions 36*e* (36*e*1 to 36*e*5) of the doctor blade 36. The camera captures light beams emitted to the outside of the development frame 30 through the SB gap G.

The cameras disposed at the five positions capture the light beams emitted to the outside of the development frame 30 through the SB gap G to measure the positions of the leading edge portions 36*e* (36*e*1 to 36*e*5) of the doctor blade 36. At this time, the cameras read the positions on the surface of the development sleeve 70 at which the distance of the development sleeve 70 from the doctor blade 36 is minimized and the leading edge portions 36*e* (36*e*1 to 36*e*5) of the doctor blade 36. Then, the pixel values of image data read and generated by the cameras are converted into distance, and the size of the SB gap G is calculated. In a case in which the calculated size of the SB gap G is not within a predetermined range, the SB gap G is adjusted. Then, if the calculated size of the SB gap G comes into the predetermined range, the position is determined as a position at which the doctor blade 36 with at least part of the maximum image region of the doctor blade 36 warped is to be fixed to the blade attachment portion 41 of the development frame 30.

Whether the SB gap G is within the predetermined range across the direction parallel to the rotation axis of the development sleeve 70 is determined using the below-described method. First, the maximum image region of the doctor blade 36 is equally divided into four or more, and the SB gap G is measured at five or more positions in each divided part (including the respective end portions and central portion of the maximum image region of the doctor blade 36) of the doctor blade 36. Then, the maximum, minimum, and median values of the SB gap G are extracted from the samples of the measurement values of the SB gap G measured at the five or more positions.

At this time, the absolute value of the difference between the maximum value of the SB gap G and the median value of the SB gap G is desirably 10% or less of the median value of the SB gap G, and the absolute value of the difference between the minimum value of the SB gap G and the median value of the SB gap G is desirably 10% or less of the median value of the SB gap G. In this case, the tolerance of the SB gap G is ±10% or less, and the condition that the SB gap G is within the predetermined range across the direction parallel to the rotation axis of the development sleeve 70 is satisfied. For example, in a case in which the median value of the SB gap G is 300 μm extracted from the samples of the measurement values of the SB gap G measured at the five or more positions, the maximum value of the SB gap G is desirably 330 μm or less and the minimum value of the SB gap G is desirably 270 μm or more. Specifically, in this case, the adjustment range of the SB gap G is 300 μm±30 μm, and the maximum allowable tolerance of the SB gap G is 60 μm.

(Linear Expansion Coefficient)

Next, a deformation of the doctor blade 36 and the development frame 30 that is caused by a change in temperature due to heat generated during the image forming operation will be described below with reference to a perspective view illustrated in FIG. 10. Examples of heat generated during the development operation include heat generated during rotation of the rotary shaft of the development sleeve 70 and the bearing 71, heat generated during rotation of the rotary shaft 33*a* of the first conveyance screw 33 and the bearing member, and heat generated when the developer passes through the SB gap G. The temperature around the development apparatus 3 is changed by the heat generated during the image forming operation, and the temperatures of the doctor blade 36, the development frame 30, and the cover frame 40 are also changed.

Figure 10:
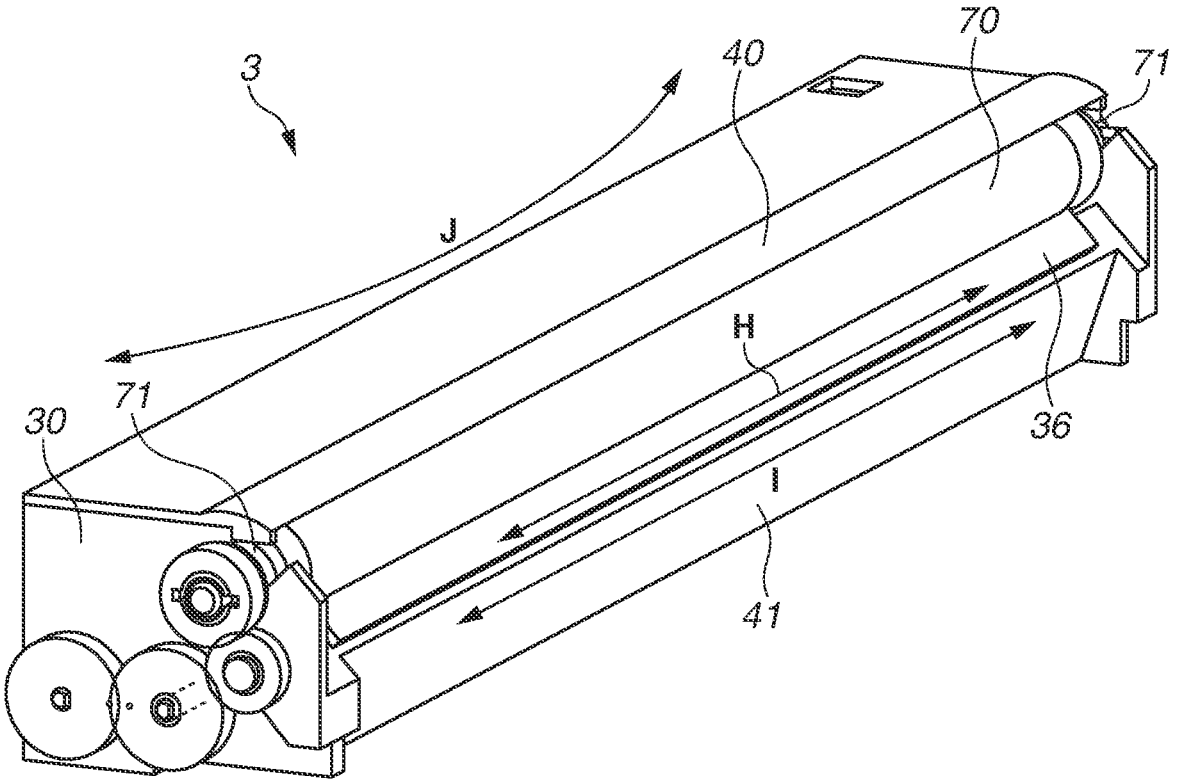
FIG. 10 is a perspective view illustrating a deformation of the doctor blade made of resin that is caused by a temperature change.

FIG. 10 illustrates the amount of expansion H [μm] of the doctor blade 36 that is caused by a temperature change and the amount of expansion 1 [μm] of the blade attachment surface 41*s* of the blade attachment portion 41 of the development frame 30 that is caused by a temperature change. Further, a linear expansion coefficient α1 of the resin forming the doctor blade 36 and a linear expansion coefficient α2 of the resin forming the development frame 30 are assumed to be different from each other. In this case, the amount of deformation of the development frame 30 that is caused by a temperature change and the amount of deformation of the doctor blade 36 that is caused by a temperature change differ from each other due to the difference in the linear expansion coefficients, and to reduce the difference between the amounts of expansion H [μm] and I [μm], the doctor blade 36 is deformed in the direction of an arrow J in FIG. 10. Hereinafter, the deformation of the doctor blade 36 in the direction of the arrow J in FIG. 10 will be referred to as "deformation of the doctor blade 36 in a warpage direction". Further, the deformation of the doctor blade 36 in the warpage direction leads to a fluctuation in the size of the SB gap G. In order to prevent a fluctuation in the size of the SB gap G that is caused by heat, the linear expansion coefficient α2 of the resin forming the sleeve support portion 42 and the blade attachment portion 41 of the development frame 30 (single item) and the linear expansion coefficient α1 of the resin forming the doctor blade 36 (single item) are related to each other. Specifically, in the case in which the linear expansion coefficient α1 of the resin forming the doctor blade 36 and the linear expansion coefficient α2 of the resin forming the development frame 30 are different, the amounts of deformation caused by a temperature change differs from each other due to the difference in the linear expansion coefficients α1 and α2.

In general, the linear expansion coefficient of a resin material is greater than the linear expansion coefficient of a metal material. In the case in which the doctor blade 36 is made of resin, a temperature change caused by heat generated during the image forming operation causes the doctor blade 36 to warp or deform, and central portion in the longer-side direction of the doctor blade 36 is likely to warp. Consequently, the size of the SB gap G is likely to fluctuate due to a temperature change during the image forming operation in the development apparatus in which the resin doctor blade 36 is fixed to the resin development frame 30.

In order to correct the straightness of the coating amount regulating surface 36*r* to 50 μm or less, at least part of the maximum image region of the doctor blade 36 is warped. Further, the doctor blade 36 with at least part of the maximum image region of the doctor blade 36 warped is fixed to the blade attachment portion 41 of the development frame 30 using the adhesive A across the entire maximum image region of the doctor blade 36.

At this time, if the linear expansion coefficient α2 of the resin forming the development frame 30 and the linear expansion coefficient α1 of the resin forming the doctor blade 36 are significantly different, the following circumstance arises when a temperature change occurs. Specifically, when a temperature change occurs, the amount of deformation (amount of expansion/contraction) of the doctor blade 36 that is caused by a temperature change and the amount of deformation (amount of expansion/contraction) of the development frame 30 that are caused by a temperature change differ from each other. Consequently, even if the SB gap G is adjusted with great accuracy at the time of determining the position at which the doctor blade 36 is to be attached to the blade attachment surface 41*s* of the development frame 30, a temperature change during the image forming operation causes a fluctuation in the size of the SB gap G.

The doctor blade 36 is fixed to the blade attachment surface 41*s* across the entire maximum image region, so that a fluctuation in the size of the SB gap G that is caused by a temperature change during the image forming operation needs to be prevented. The amount of fluctuation in the SB gap G that is caused by heat needs to be reduced to, in general, ±20 μm or less in order to prevent a variation in the amount of developer borne on the surface of the development sleeve 70 in the longer-side direction of the development sleeve 70.

Hereinafter, the difference between the linear expansion coefficient α2 of the resin forming the development frame 30 including the sleeve support portion 42 and the blade attachment portion 41 and the linear expansion coefficient α1 of the resin forming the doctor blade 36 will be referred to as "linear expansion coefficient difference α2−α1". A change in the maximum amount of the warp of the doctor blade 36 due to the linear expansion coefficient difference α2−α1 will be described below with reference to Table 1. The maximum amount of the warp of the doctor blade 36 was measured when the temperature was changed from room temperature (23° C.) to high temperature (40° C.) in the state that the doctor blade 36 is fixed to the blade attachment portion 41 of the development frame 30 over the entire maximum image region of the doctor blade 36.

The linear expansion coefficient of the resin forming the development frame 30 including the sleeve support portion 42 and the blade attachment portion 41 is denoted by α2 [m/° C.], and the linear expansion coefficient of the resin forming the doctor blade 36 is denoted by α1 [m/° C.]. Table 1 indicates the results of measurement of the maximum amount of the warp of the doctor blade 36 using changed parameters of the linear expansion coefficient difference α2−α1. In Table 1, the maximum amount of the warp is "Good" in the case in which the absolute value of the maximum amount of the warp of the doctor blade 36 is 20 μm or less, whereas the maximum amount of the warp is "Not Good" in the case in which the absolute value of the maximum amount of the warp of the doctor blade 36 exceeds 20 μm.

TABLE 1

| | | | | | | | | | |
|---|---|---|---|---|---|---|---|---|---|
| Linear Expansion Coefficient Difference α2 − α1 [$\times 10^{-5}$ m/° C.] | 0 | +0.20 | +0.40 | +0.50 | +0.54 | +0.55 | +0.56 | +0.57 | +0.60 |
| Maximum Amount of the warp of Doctor Blade | Good | Good | Good | Good | Good | Good | Not Good | Not Good | Not Good |
| Linear Expansion Coefficient Difference α2 − α1 [$\times 10^{-5}$ m/° C.] | 0 | −0.20 | −0.40 | −0.44 | −0.45 | −0.46 | −0.47 | −0.50 | |
| Maximum Amount of the warp of Doctor Blade | Good | Good | Good | Good | Good | Not Good | Not Good | Not Good | |

As understood from Table 1, in order to reduce the amount of fluctuation in the SB gap G that is caused by heat to ±20 μm or less, the linear expansion coefficient difference α2−α1 needs to satisfy the following relational formula.

$$-0.45\times10^{-5}[m/^\circ\ \text{C.}]\leq\alpha2-\alpha1\leq0.55\times10^{-5}[m/^\circ\ \text{C.}] \quad \text{(formula 1)}$$

Thus, the resin to form the development frame 30 and the resin to form the doctor blade 36 may be selected in such a manner that the linear expansion coefficient difference α2−α1 is $-0.45\times10^{-5}$ [m/° C.] or more and $0.55\times10^{-5}$ [m/° C.] or less. In a case in which the same resin is selected as the resin to form the development frame 30 and the resin to form the doctor blade 36, the linear expansion coefficient difference α2−α1 becomes zero.

If the adhesive A is applied to the development frame 30, the linear expansion coefficient of the development frame 30 to which the adhesive A is applied changes. However, the volume of the adhesive A applied to the development frame 30 is small enough to ignore the effect of a temperature change on a size fluctuation in the thickness direction of the adhesive A. Thus, a deformation in the warpage direction of the doctor blade 36 that is caused by a change in the linear expansion coefficient difference α2−α1 in the case in which the adhesive A is applied to the development frame 30 can be ignored.

Similarly, the cover frame 40 is fixed to the development frame 30, so that if the amount of deformation of the development frame 30 that is caused by a temperature change and the amount of deformation of the cover frame 40 that is caused by a temperature change differ from each other, and thereby a deformation in the warpage direction of the cover frame 40 leads to a fluctuation in the size of the SB gap G. The linear expansion coefficient of the resin forming the development frame 30 including the sleeve support portion 42 and the blade attachment portion 41 is denoted by α2 [m/° C.], and the linear expansion coefficient of the resin of the cover frame 40 is denoted by α3 [m/° C.]. Hereinafter, the difference between the linear expansion coefficient α2 of the resin forming the development frame 30 including the sleeve support portion 42 and the blade attachment portion 41 and the linear expansion coefficient α3 of the resin forming the cover frame 40 will be referred to as "linear expansion coefficient difference α3−α2". At this time, the linear expansion coefficient difference α3−α2 needs to satisfy the following relational formula (formula 2) as in Table 1.

$$-0.45\times10^{-5}[m/^\circ\ \text{C.}]\leq\alpha3-\alpha2\leq0.55\times10^{-5}\ [m/^\circ\ \text{C.}] \quad \text{(formula 2)}$$

Thus, the resin forming the development frame 30 and the resin forming the cover frame 40 may be selected in such a manner that the linear expansion coefficient difference α3−α2 is $-0.45\times10^{-5}$ [m/° C.] or more and $0.55\times10^{-5}$ [m/° C.] or less. In a case in which the same resin is selected as the resin forming the development frame 30 and the resin forming the cover frame 40, the linear expansion coefficient difference α3−α2 becomes zero.

(Agent Pressure)

Figure 11:
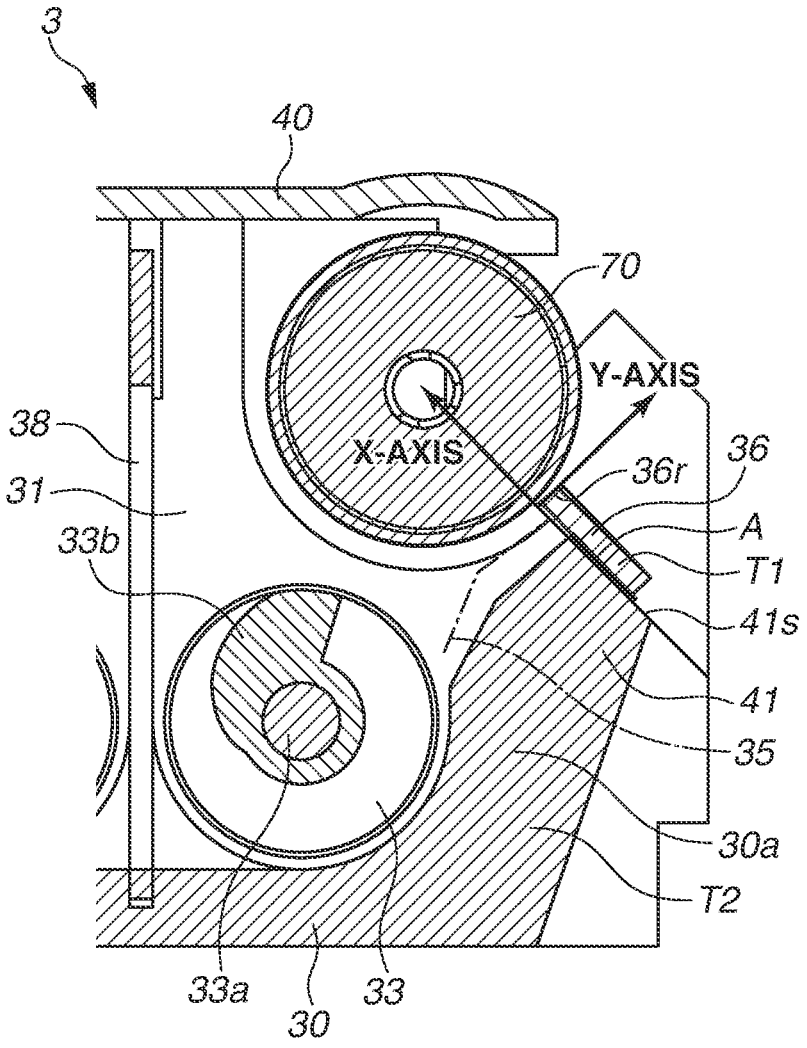
FIG. 11 is a cross-sectional view illustrating a deformation of the doctor blade made of resin that is caused by an agent pressure.

Next, a deformation in the doctor blade 36 that is caused by application of the agent pressure generated by the flow of the developer to the doctor blade 36 during the image forming operation will be described below with reference to a cross-sectional view illustrated in FIG. 11. FIG. 11 is a cross-sectional view illustrating the development apparatus 3 along a cross-section (cross-section H in FIG. 2) orthogonal to the rotation axis of the development sleeve 70. Further, FIG. 11 illustrates a structure in the neighborhood of the doctor blade 36 fixed to the blade attachment portion 41 of the development frame 30 using the adhesive A.

As illustrated in FIG. 11, a line connecting the nearest position of the doctor blade 36 on the coating amount regulating surface **36*r* with respect to the development sleeve 70 and the rotation center of the development sleeve 70 is determined as an X-axis. At this time, the doctor blade 36 extends in the X-axis direction and has high rigidity of the cross-section in the X-axis direction. Further, as illustrated in FIG. 11, the proportion of a cross-sectional area T1 of the doctor blade 36 with respect to a cross-sectional area T2 of a wall portion 30*a* of the development frame 30 that is positioned near the developer guide portion 35** is small.

As described above, the rigidity of the development frame 30 (single item) is ten or more times higher than the rigidity of the doctor blade 36 (single item). Thus, in the state in which the doctor blade 36 is fixed to the blade attachment portion 41 of the development frame 30, the rigidity of the development frame 30 becomes dominant with respect to the rigidity of the doctor blade 36. Consequently, the amount of displacement (maximum amount of the warp) of the coating amount regulating surface **36*r* of the doctor blade 36 when the agent pressure is applied to the doctor blade 36 during the image forming operation is substantially equivalent to the amount of displacement (maximum amount of the warp) of the development frame 30**.

During the image forming operation, the developer drawn from the first conveyance screw 33 passes through the developer guide portion 35 and is conveyed to the surface of the development sleeve 70. Thereafter, when the layer thickness of the developer is regulated by the doctor blade 36 according to the size of the SB gap G, the doctor blade 36 receives the agent pressure from various directions. As illustrated in FIG. 11, when the direction orthogonal to the X-axis direction (direction in which the SB gap G is defined) is the Y-axis direction, the agent pressure in the Y-axis direction is perpendicular to the blade attachment surface 41*s* of the development frame 30. Specifically, the agent pressure in the Y-axis direction is a force in the direction of stripping the doctor blade 36 off the blade attachment surface 41*s*. Thus, the bonding force of the adhesive A needs to be sufficiently stronger than the agent pressure in the Y-axis direction. Thus, the force of the agent pressure that strips the doctor blade 36 off the blade attachment surface 41*s* and the bonding force of the adhesive A are taken into consideration in optimizing the area and thickness of the adhesive A to be bonded and applied to the blade attachment surface 41*s*.

(Method of Bonding Doctor Blade Made of Resin)

As described above, as the width of the sheet S on which an image is to be formed is increased, the length of the maximum image region of the doctor blade 36 in the longer-side direction increases. In the case of resin-molding the doctor blade 36 that extends in the longer-side direction, the rate of thermal contraction of the thermally expanded resin often varies in the longer-side direction of the doctor blade 36. Thus, in the case in which the doctor blade 36 extending in the longer-side direction is resin-molded with a normal accuracy of a resin-molded article, it is difficult to guarantee the straightness of the coating amount regulating surface 36*r* of the resin-molded doctor blade 36.

Thus, in the first exemplary embodiment, at least part of the maximum image region of the doctor blade 36 is warped in order to correct the straightness of the coating amount regulating surface 36*r* of the doctor blade 36 that extends in the longer-side direction to 50 μm or less. Then, the doctor blade 36 with at least part of the maximum image region of the doctor blade 36 warped is attached and fixed to the blade attachment portion 41 using the adhesive A. In this way, the region warped to correct the straightness of the coating amount regulating surface 36*r* in the maximum image region of the doctor blade 36 is prevented from returning from the warped state to the original state before the warp. In order to prevent the doctor blade 36 from returning from the warped state to the original state, it is desirable to fix the doctor blade 36 to the blade attachment portion 41 using the adhesive A across the entire maximum image region of the doctor blade 36. In order to fix the doctor blade 36 in the warped state using the adhesive A across the entire maximum image region of the blade attachment portion 41, the adhesive A needs to be applied across the entire maximum image region of the blade attachment surface 41*s*.

In the first exemplary embodiment, the doctor blade 36 is attached and fixed to the blade attachment portion 41 using the adhesive A. In such a configuration, the adhesive A having a predetermined layer thickness is applied to the blade attachment surface 41*s*. There is an adhesive application apparatus configured to apply the adhesive A to the blade attachment surface 41*s* by moving an adhesive application unit (e.g., dispenser with a nozzle) in the longer-side direction. In a case of using such an adhesive application apparatus, with a normal accuracy of the adhesive application apparatus, the layer thickness of the adhesive A applied to the blade attachment surface 41*s* by the adhesive application apparatus varies in the longer-side direction of the blade attachment surface 41*s*.

If the length of the maximum image region of the doctor blade 36 in the longer-side direction increases as the width of the sheet S on which an image is to be formed is increased, the length of the maximum image region of the blade attachment surface 41*s* in the longer-side direction to which the doctor blade 36 is to be attached also increases. Further, as the length of the maximum image region of the blade attachment surface 41*s* in the longer-side direction is longer, the layer thickness of the adhesive A applied to the blade attachment surface 41*s* by the adhesive application apparatus is more likely to vary in the longer-side direction of the blade attachment surface 41*s*.

The length of time (hereinafter, referred to simply as "adhesive hardening time") needed to harden the adhesive so as to obtain a sufficient bonding strength of the doctor blade 36 with respect to the blade attachment surface 41*s* is proportional to the layer thickness of the adhesive A. In other words, the adhesive hardening time becomes longer as the layer thickness of the adhesive A is thicker, and the adhesive hardening time becomes shorter as the layer thickness of the adhesive A is thinner. Thus, if the layer thickness of the adhesive A applied to the blade attachment surface 41*s* varies in the longer-side direction of the blade attachment surface 41*s*, the adhesive hardening time of the adhesive A applied to the blade attachment surface 41*s* varies in the longer-side direction of the blade attachment surface 41*s*. A case in which the adhesive application apparatus applies the adhesive A to the blade attachment surface 41*s*, to which the doctor blade 36 that extends in the longer-side direction is to be attached, across the entire maximum image region of the blade attachment surface 41*s* will be discussed below. Especially in this case, the adhesive hardening time of the adhesive A is likely to vary significantly in the longer-side direction of the blade attachment surface 41*s*.

Further, in a case of using a commonly-used adhesive (e.g., cyanoacrylate-based adhesive), it may take about one minute or only about one second to harden the adhesive sufficiently to obtain a sufficient bonding strength, so that there is also a factor of variation in the accuracy of the material of the adhesive.

In the case in which the adhesive hardening time varies significantly in the longer-side direction of the blade attachment surface 41*s*, when a predetermined time passes after the adhesive A is applied, the adhesive A is sufficiently hardened at some portions in the longer-side direction of the blade attachment surface 41*s* but is not sufficiently hardened at some other portions. The apparatus applies a predetermined pressure to the doctor blade 36 at the time of bonding the doctor blade 36 to the blade attachment surface 41*s* to which the adhesive A is applied. In the case in which the adhesive is sufficiently hardened at some portions and is not sufficiently hardened at some other portions in the longer-side direction of the blade attachment surface 41*s*, the length of time to be spent in the bonding step needs to be set according to the portions at which the adhesive A is not sufficiently hardened. Specifically, even if the adhesive A is sufficiently hardened at some portions, as long as there are some other portions where the adhesive A is not sufficiently hardened, the apparatus continuously applies a predetermined pressure to the doctor blade 36 until the adhesive A at the portions at which the adhesive A is not sufficiently hardened is sufficiently hardened. Thus, a possible variation in the layer thickness of the adhesive A applied to the blade attachment surface 41*s* by the adhesive application apparatus is estimated in advance, and the length of time to be spent in the bonding step in the process of manufacturing the development apparatus 3 is set based thereon.

From the point of view of mass production, time spent in the bonding step in the process of manufacturing the development apparatus 3 is desirably short, and adhesive hardening time in the bonding step is also desirably short. This is because, if the adhesive hardening time is reduced, the takt time is reduced, which is advantageous from the point of view of mass production. As described above, the adhesive hardening time is determined based on the layer thickness of the applied adhesive A (specifically, the amount of applied adhesive A).

Thus, the amount of the adhesive to be applied to the blade attachment surface 41*s* by the adhesive application apparatus during the bonding step is set as described below. Specifically, as described above, the force of the agent pressure that strips the doctor blade 36 off the blade attachment surface 41*s* and the bonding force of the adhesive A are taken into consideration in optimizing the bonding area and thickness of the adhesive A to be bonded and applied to the blade attachment surface 41*s*. How to prevent a variation in the adhesive hardening time that is caused by a variation in the layer thickness of the adhesive A applied to the blade attachment surface 41*s* in the case of using a commonly-used adhesive material as the adhesive A and setting the amount of the adhesive A to be applied to the blade attachment surface 41*s* to an appropriate amount will be discussed below. As to a variation in the adhesive hardening time, the longer the adhesive hardening time is, the more the adhesive hardening time varies, and the shorter the adhesive hardening time is, the less the adhesive hardening time varies. Thus, in order to reduce the variation in the adhesive hardening time in the case where the resin doctor blade 36 that extends in the longer-side direction is fixed to the blade attachment portion 41 using the adhesive A, a hardening accelerator for accelerating the hardening of the adhesive may be used to accelerate the hardening of the adhesive. More specifically, the hardening accelerator is applied to the bonding surface of the doctor blade 36, whereas the adhesive A is applied to the blade attachment surface 41*s*. In this way, the adhesive A applied to the blade attachment surface 41*s* and the hardening accelerator applied to the bonding surface of the doctor blade 36 chemically react with each other, thereby accelerating the hardening of the adhesive A when the doctor blade 36 is bonded to the blade attachment surface 41*s*.

In the first exemplary embodiment as described above, while the variation in the adhesive hardening time at the time of bonding the resin doctor blade that extends in the longer-side direction to the development frame made of resin is prevented, the SB gap is adjusted to be within the predetermined range across the longer-side direction of the developer bearing member. Details thereof will be described below.

(Adhesive)

In the first exemplary embodiment, the adhesive A applied to the blade attachment surface 41*s* is hardened in the state that the doctor blade 36 in the warped state is attached to the blade attachment portion 41 so that the doctor blade 36 is fixed to the blade attachment portion 41 via the adhesive A. The adhesive A that has a sufficient bonding strength so that the doctor blade 36 is not separated from the blade attachment surface 41*s* of the development frame 30 during the image forming operation (development operation) needs to be selected. The load applied to the doctor blade 36 during the image forming operation (development operation) is about 2 kgf in a drop test, and the doctor blade 36 is satisfactory if the doctor blade 36 under a load equivalent thereto is not separated from the blade attachment surface 41*s* of the development frame 30. It is known that a sufficient bonding strength is obtainable with a commonly-used adhesive A, and from the point of view of mass production, a shorter adhesive hardening time is better.

The layer thickness of the adhesive A applied to the blade attachment surface 41*s* of the development frame 30 will be described below. Since the doctor blade 36 and the blade attachment surface 41*s* of the development frame 30 are bound together using the adhesive A, the adhesive A is between the doctor blade 36 and the blade attachment surface 41*s* of the development frame 30. Thus, in order to prevent the adhesive A between the doctor blade 36 and the blade attachment surface 41*s* of the development frame 30 from affecting the size of the SB gap G, the layer thickness of the adhesive A to be applied to the blade attachment surface 41*s* needs to be carefully considered.

In the relationship between the layer thickness of the adhesive A and the breaking load of the portion bonded with the adhesive A, the larger the amount of the adhesive A is, the higher the bonding strength of the adhesive A becomes. As described above, the load applied to the doctor blade 36 during the image forming operation (development operation) is about 2 kgf, and a required bonding strength of the adhesive A in the first exemplary embodiment is set to 10 kgf or more with a margin. To obtain a bonding strength of 10 kgf or more as the bonding strength of the adhesive A, the layer thickness of the adhesive A applied to the blade attachment surface 41*s* of the development frame 30 is desirably set to 20 μm or more.

Next, the relationship between the thickness of the adhesive A to be applied and the dimensional fluctuation in the thickness direction of the adhesive A will be described below. In general, as the layer thickness of the adhesive A is increased, a dimensional fluctuation in the thickness direction of the adhesive A that is caused by contraction of the adhesive A during hardening of the adhesive A occurs. Meanwhile, the dimensional fluctuation in the thickness direction of the adhesive A in a case in which the layer thickness of the adhesive A is 150 μm is greater only by about 8 μm than the dimensional fluctuation in the thickness direction of the adhesive A in a case in which the layer thickness of the adhesive A is 30 μm. If the difference in dimensional fluctuation in the thickness direction of the adhesive A is about 8 μm, it can be ignored as an effect of the dimensional fluctuation in the direction (specifically, direction in which the SB gap G is defined) orthogonal to the thickness direction of the adhesive A. Thus, the upper limit of the layer thickness of the adhesive A to be applied to the blade attachment surface 41*s* of the development frame 30 can be determined not based on an effect of the concentration of the adhesive A but based on individual production conditions such as the adhesive hardening time and cost.

It is necessary to select an adhesive A that has a sufficient bonding strength so that the doctor blade 36 is not stripped off during use. The load applied to the doctor blade 36 is about 2 kgf in a drop test, and the adhesive A is satisfactory if the doctor blade 36 is not stripped off under the load. It is known that a sufficient bonding strength is obtained with a commonly-used cyanoacrylate-based adhesive. Thus, in the first exemplary embodiment, a description is given using an example in which a commonly-used cyanoacrylate-based adhesive is used as the adhesive A. The cyanoacrylate-based adhesive initiates a chain polymerization reaction with an alkaline material acting as a catalyst, and thereby the cyanoacrylate-based adhesive is hardened through polymerization. A mechanism whereby the cyanoacrylate-based adhesive is hardened will be described below.

Figure 12:
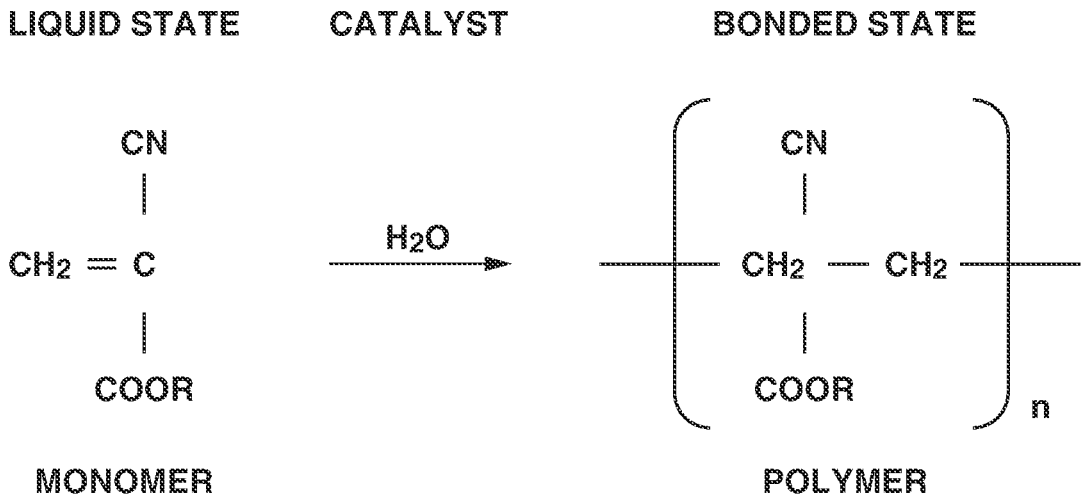
FIG. 12 illustrates chemical formulae of an adhesive.

FIG. 12 illustrates chemical formulae of the cyanoacrylate-based adhesive. As illustrated in FIG. 12, the cyanoacrylate-based adhesive in a liquid state normally exists in form of monomer. A situation in which the cyanoacrylate-based adhesive is hardened indicates that monomers cause a chain polymerization reaction and are polymerized. In order for the monomers to cause a chain polymerization reaction, a catalyst for initiating the chain polymerization reaction is needed, and the alkaline material serves as the catalyst. In general, the moisture content in the air plays the role of the catalyst. More specifically, although pure water (H20) is neutral, the moisture content in the air is weakly alkaline because impurities are normally contained in the moisture content. Thus, the moisture content in the air functions as the catalyst for the cyanoacrylate-based adhesive. Thus, the humidity in an environment in which the adhesive is used affects the adhesive hardening time. In order to accelerate the adhesive hardening time while preventing a variation in the adhesive hardening time that is caused by a difference in humidity in the environment in which the adhesive is used, a method using a hardening accelerator to accelerate the hardening of the adhesive is commonly used.

Many instant adhesives generally available on the market are labelled "cyanoacrylate 100%", but some of them contain a small amount of acidic substance added to the cyanoacrylate-based adhesive to prevent the adhesive from being hardened through a chain polymerization reaction in a preserved state. In a case in which a commonly-used cyanoacrylate-based adhesive is used, it may take about one minute or only about one second until the adhesive is sufficiently hardened to obtain a sufficient bonding strength, so that there is also a factor of variation in the accuracy of the material of the adhesive.

(Hardening Accelerator)

Figure 13:
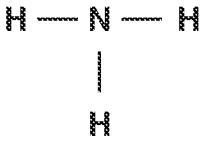
FIG. 13 illustrates chemical formulae of a hardening accelerator.
Figure 13:
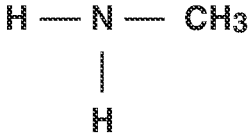

In the first exemplary embodiment, a description will be given using an example in which, as a hardening accelerator, a hardening accelerator for a cyanoacrylate-based adhesive, i.e., a solvent that contains an alkaline amine compound and acetone or alcohol as a solvent, is used. FIG. 13 illustrates chemical formulae of the hardening accelerator for the cyanoacrylate-based adhesive. The hardening accelerator in a preserved state exists in a liquid state. The term "amine compound" is a generic term for compounds derived by replacing a hydrogen atom(s) of ammonia ($NH_3$) by a hydrocarbon radical(s) or an aromatic atomic group(s). While one hydrogen atom is replaced by a hydrocarbon radical in the example illustrated in FIG. 13, the number of hydrogen atom to be replaced can be two or three. The amine compound derived by replacing one hydrogen atom is referred to as "primary amine". The amine compound derived by replacing two hydrogen atoms is referred to as "secondary amine". The amine compound derived by replacing three hydrogen atoms is referred to as "tertiary amine". The solvent (acetone, alcohol) of the hardening accelerator containing the amine compound is volatile.

As illustrated in FIG. 13, when the hardening accelerator for the cyanoacrylate-based adhesive is applied, the solvent (acetone, alcohol) evaporates in two to three seconds, and the amine compound contained therein remains on the surface to which the hardening accelerator is applied. Then, the amine compound remaining on the surface and the cyanoacrylate-based adhesive are brought into contact with each other to thereby initiate a chain polymerization reaction so that the hardening of the adhesive is accelerated. The level of acceleration of the hardening of the cyanoacrylate-based adhesive by the hardening accelerator for the cyanoacrylate-based adhesive (specifically, length of time before cyanoacrylate-based adhesive is hardened) is controllable by controlling the amount of the amine compound solved in the solvent of the hardening accelerator.

(Bonding Process)

Figure 14:
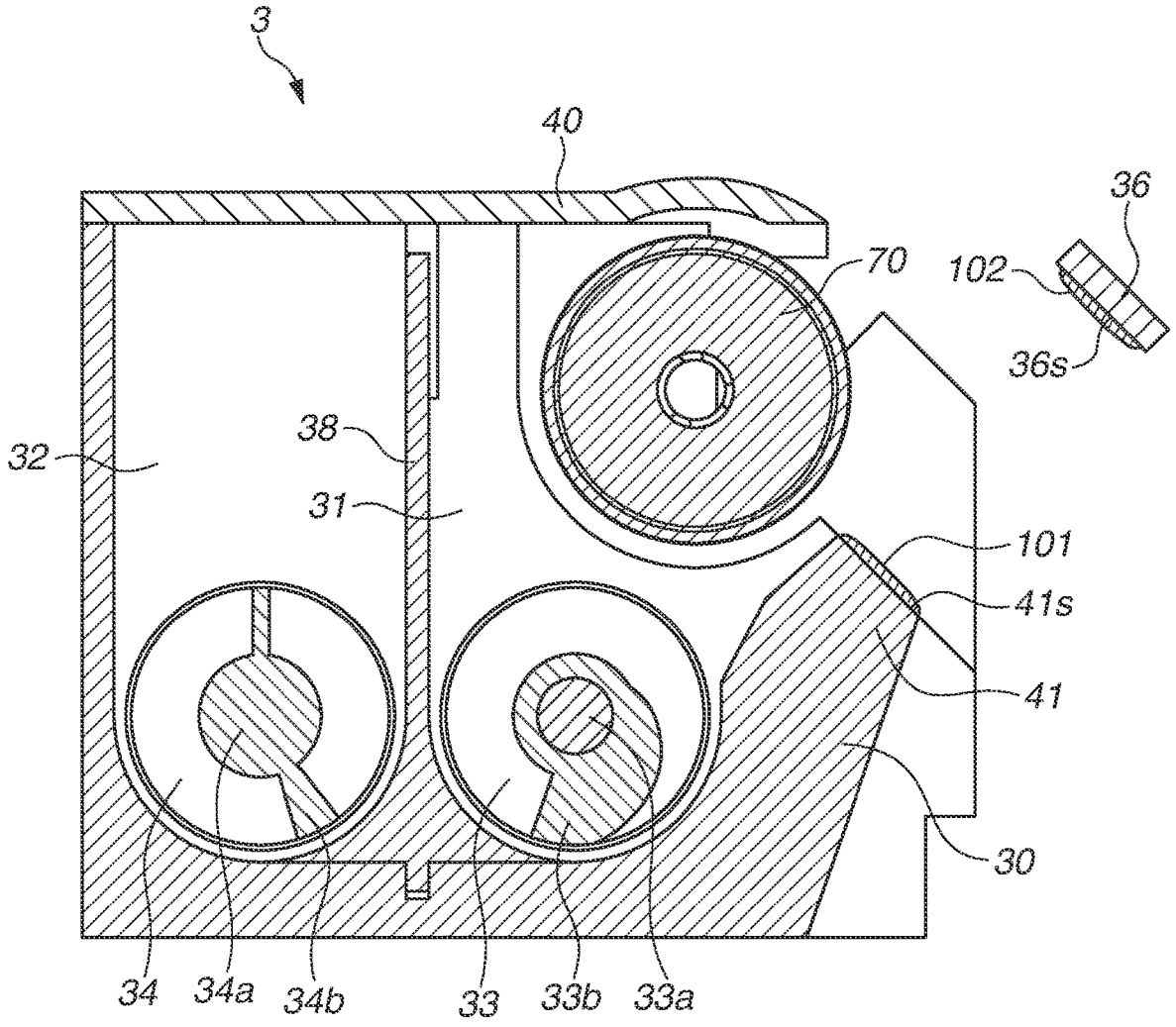
FIG. 14 is a schematic view illustrating a step of a method of bonding the doctor blade made of resin according to the first exemplary embodiment.

Next, details of the bonding step of bonding the doctor blade 36 according to the first exemplary embodiment will be described below with reference to a schematic view illustrated in FIG. 14. In the first exemplary embodiment, as illustrated in FIG. 14, the cyanoacrylate-based adhesive (hereinafter, referred to simply as "adhesive 101") is applied to the blade attachment surface 41*s* of the development frame 30. Further, the hardening accelerator for the cyanoacrylate-based adhesive (hereinafter, also referred to simply as "hardening accelerator 102"), which is a volatile hardening accelerator, is applied to the bonding surface 36*s* of the doctor blade 36.

In the first exemplary embodiment, the doctor blade 36 is warped such that the SB gap G is within the predetermined range across the longer-side direction of the development sleeve 70, and the doctor blade 36 in the warped state is fixed to the blade attachment portion 41 using the adhesive 101. At this time, in order to prevent the doctor blade 36 from returning from the warped state to the original state, the doctor blade 36 in the warped state needs to be bonded to the entire maximum image region of the blade attachment portion 41. Thus, in the first exemplary embodiment, the adhesive 101 is applied to the entire maximum image region of the blade attachment surface 41*s* of the development frame 30, and the hardening accelerator 102 is applied to an entire maximum image region of a bonding surface 36*s* of the doctor blade 36.

As described above, the state in which the adhesive 101 is applied across the entire maximum image region of the blade attachment surface 41*s* of the development frame 30 is a state in which the following condition is satisfied. Specifically, when the doctor blade 36 is attached to the blade attachment portion 41, the adhesive 101 is applied to 95% or more (including the region warped to correct the straightness of the coating amount regulating surface 36*r* in the region that corresponds to the maximum image region of the doctor blade 36) of the maximum image region of the blade attachment surface 41*s* of the development frame 30.

Similarly, the state in which the hardening accelerator 102 is applied to the entire maximum image region of the bonding surface 36*s* of the doctor blade 36 is a state in which the following condition is satisfied. Specifically, when the doctor blade 36 is attached to the blade attachment portion 41, the hardening accelerator 102 is applied to 95% or more (including the region warped to correct the straightness of the coating amount regulating surface 36*r* in the region that corresponds to the maximum image region of the bonding surface 36*s* of the doctor blade 36) of the maximum image region of the bonding surface 36*s* of the doctor blade 36.

As described above, the solvent of the hardening accelerator 102 containing the amine compound is volatile, and after the solvent evaporates in two to three seconds, the amine compound remains on the surface to which the amine compound is applied, so that an effect of accelerating the hardening of the adhesive is produced. In other words, the hardening accelerator 102 is applied to the doctor blade 36, and after the solvent of the hardening accelerator 102 evaporates, a force for warping the doctor blade 36 is exerted on the doctor blade 36 in such a manner that the SB gap G is within the predetermined range across the longer-side direction of the development sleeve 70. Although the force for warping the doctor blade 36 is exerted on the doctor blade 36 in this way, the solvent of the hardening accelerator 102 applied to the doctor blade 36 evaporates, so that the hardening accelerator 102 applied to the doctor blade 36 is not likely to drip off from the doctor blade 36. Similarly, the hardening accelerator 102 is applied to the doctor blade 36, and after the solvent evaporates, the orientation of the doctor blade 36 is changed so as to be attached to the blade attachment portion 41. Although the orientation of the doctor blade 36 is changed as described above, the solvent of the hardening accelerator 102 applied to the doctor blade 36 evaporates, so that the hardening accelerator 102 applied to the doctor blade 36 is not likely to drip off from the doctor blade 36.

Further, as described above, in the case of using the cyanoacrylate-based adhesive which is a commonly-used adhesive, the length of time needed for the adhesive to be hardened to obtain a sufficient bonding strength varies from several seconds to about one minute. The longer adhesive hardening time indicates lower productivity, and in order to increase the productivity, the adhesive hardening time needs to be reduced by using the hardening accelerator 102. Thus, the level of acceleration of the hardening of the adhesive 101 is controlled by controlling the amount of the amine compound contained in the hardening accelerator 102. In the first exemplary embodiment, the amount of the hardening accelerator 102 to be applied to the bonding surface 36*s* of the doctor blade 36 and the concentration of the amine compound are optimized to realize an appropriate hardening time by using the hardening accelerator 102 to adjust the hardening so that the adhesive 101 is hardened in about five seconds.

A method for applying the adhesive 101 to the blade attachment surface 41*s* of the development frame 30 and a method for applying the hardening accelerator 102 to the bonding surface 36*s* of the doctor blade 36 will be described below. Since the adhesive 101 and the hardening accelerator 102 are both liquid, the adhesive 101 and the hardening accelerator 102 are stored in respectively different tanks.

The adhesive 101 stored in the tank is pumped, and a substantially fixed amount of the adhesive 101 is applied to the blade attachment surface 41*s* across the longer-side direction thereof by a dispenser equipped with a needle-like nozzle provided to the leading edge while the dispenser is moved. At this time, the moving speed of the dispenser is managed by the adhesive application apparatus, and the dispenser is moved at constant speed. In this way, the amount of the adhesive 101 applied per unit area is stabilized.

Similarly, the hardening accelerator 102 stored in the different tank is pumped, and a substantially fixed amount of the hardening accelerator 102 is applied to the bonding surface 36*s* of the doctor blade 36 across the longer-side direction thereof by a dispenser equipped with a needle-like nozzle provided to the leading edge while the dispenser is moved. At this time, the moving speed of the dispenser is managed by the adhesive application apparatus, and the dispenser is moved at constant speed. In this way, the amount of the hardening accelerator 102 applied per unit area is stabilized.

As described above, in the first exemplary embodiment, the adhesive 101 is applied across the entire maximum image region of the blade attachment portion 41 of the development frame 30. Further, the hardening accelerator 102 is applied across the entire maximum image region of the bonding surface 36*s* of the doctor blade 36.

Further, the force for warping the doctor blade 36 is exerted on the doctor blade 36 in such a manner that the SB gap G is within the predetermined range across the longer-side direction of the development sleeve 70. At this time, the doctor blade 36 is warped by the force exerted on the doctor blade 36, and the SB gap G is within the predetermined range across the longer-side direction of the development sleeve 70. In this state, the doctor blade 36 to which the hardening accelerator 102 is applied is bonded to the blade attachment portion 41 to which the adhesive 101 is applied. In this way, while a variation in the hardening time of the adhesive 101 is prevented at the time of bonding the resin doctor blade 36 that extends in the longer-side direction to the development frame 30 made of resin, the SB gap G can be within the predetermined range across the longer-side direction of the development sleeve 70.

Figure 15:
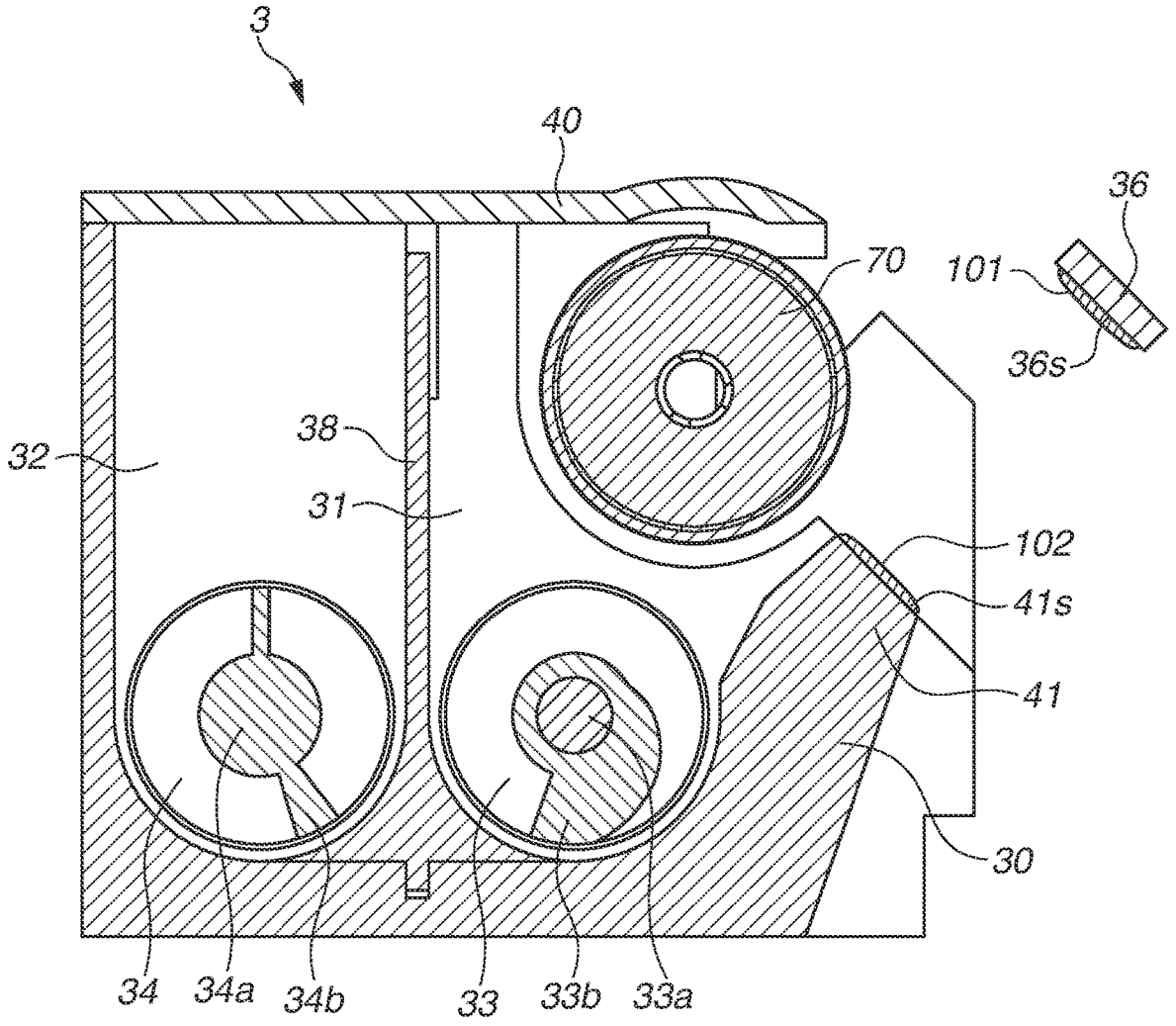
FIG. 15 is a schematic view illustrating a step of a method of bonding the doctor blade made of resin according to a second exemplary embodiment.

A second exemplary embodiment will be described below. In the above-described first exemplary embodiment, the example is described in which the adhesive 101 is applied to the entire maximum image region of the blade attachment surface 41*s* of the development frame 30 and the hardening accelerator 102 is applied across the entire maximum image region of the bonding surface 36*s* of the doctor blade 36. In a second exemplary embodiment, the hardening accelerator 102 is applied across the entire maximum image region of the blade attachment surface 41*s* of the development frame 30, and the adhesive 101 is applied across the entire maximum image region of the bonding surface 36*s* of the doctor blade 36. Only the difference of the second exemplary embodiment from the first exemplary embodiment will be described below, and description of those that are similar to those in the first exemplary embodiment is omitted. Details of the bonding step of bonding the doctor blade 36 according to the second exemplary embodiment will be described below with reference to a schematic view illustrated in FIG. 15.

The state in which the hardening accelerator 102 is applied across the entire maximum image region of the blade attachment surface 41*s* is a state in which the following condition is satisfied. Specifically, the hardening accelerator 102 is applied to 95% or more (including the region warped to correct the straightness of the coating amount regulating surface 36*r* in the region that corresponds to the maximum image region of the doctor blade 36) of the maximum image region of the blade attachment surface 41*s* when the doctor blade 36 is attached to the blade attachment portion 41.

Similarly, the state in which the adhesive 101 is applied across the entire maximum image region of the bonding surface 36*s* of the doctor blade 36 is a state in which the following condition is satisfied. Specifically, the adhesive 101 is applied to 95% or more (including the region warped to correct the straightness of the coating amount regulating surface 36*r* in the region that corresponds to the maximum image region of the doctor blade 36) of the maximum image region of the bonding surface 36*s* of the doctor blade 36 when the doctor blade 36 is attached to the blade attachment portion 41.

The example according to the second exemplary embodiment is similar to the example according to the first exemplary embodiment in terms of the effect of preventing a variation in the hardening time of the adhesive 101 at the time of bonding the resin doctor blade 36 that extends in the longer-side direction to the development frame 30 made of resin. However, since the development apparatus 3 is an industrial article to be mass-produced, from the point of view of productivity of mass production, the example according to the first exemplary embodiment is more desirable than the example according to the second exemplary embodiment. The reason is as described below.

The process for manufacturing the development apparatus 3 include sequentially assembling (combining) various components such as the development sleeve 70, the doctor blade 36, and the cover frame 40 to the development frame 30, which is a main component of the development apparatus 3, and the development apparatus 3 is completed thereby. Specifically, the orientation of the development frame 30 is basically not changed during the manufacturing process of the development apparatus 3. Changing the orientation of the development frame 30 during the manufacturing process of the development apparatus 3 involves an operation of placing the development frame 30 upside down or holding and turning the development frame 30 by the operator or the manufacturing apparatus. These operations are normally to be avoided because the components attached to the development frame 30 may come off the development frame 30 due to the gravitational force and centrifugal force.

Further, when it is necessary to change the orientation of a component, it is easy and common to change the orientation of a component that has a smaller volume and is lighter. Thus, in the above-described first exemplary embodiment, instead of the orientation of the development frame 30, which is a main component of the development apparatus 3, the orientation of the doctor blade 36, which has a smaller volume and is lighter than the development frame 30, is changed.

Returning to the description of the first exemplary embodiment, the orientations of the development frame 30 and the doctor blade 36 at the time of applying the adhesive 101 and the hardening accelerator 102 according to the first exemplary embodiment will be described below with reference to a schematic view illustrated in FIG. 16. Further, the orientations of the development frame 30 and the doctor blade 36 at the time of bonding the development frame 30 and the doctor blade 36 will be described below with reference to a schematic view illustrated in FIG. 17.

Figure 16:
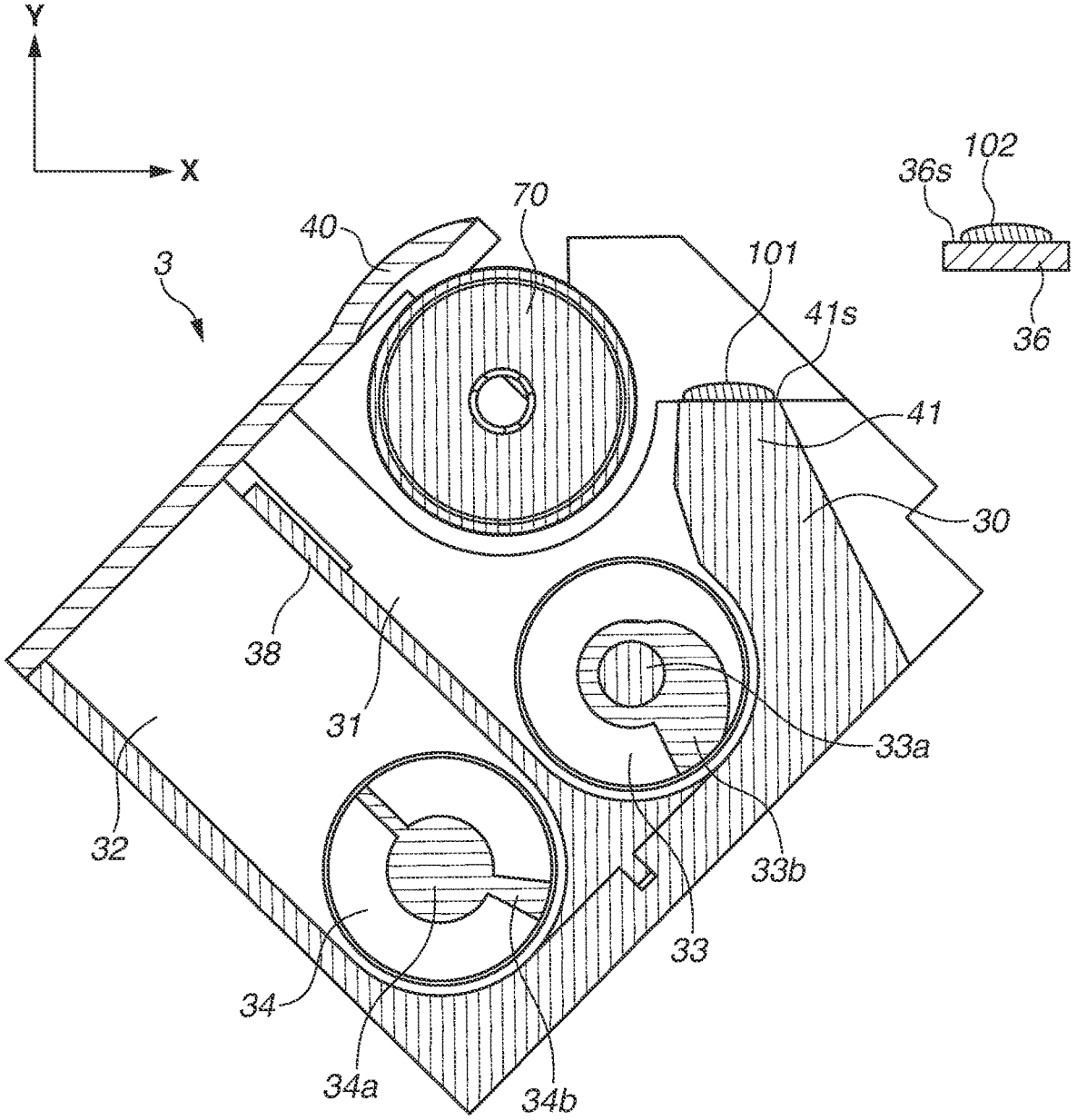
FIG. 16 is a schematic view illustrating orientations of the development frame and the doctor blade during application of the adhesive and the hardening accelerator.

As illustrated in FIG. 16, the adhesive 101 is applied to the blade attachment surface 41*s* of the development frame 30 by the adhesive application apparatus in the state in which the development frame 30 is placed substantially horizontally in the apparatus. Similarly, as illustrated in FIG. 16, the hardening accelerator 102 is applied to the bonding surface 36*s* of the doctor blade 36 by the hardening accelerator application apparatus in the state in which the doctor blade 36 is placed substantially horizontally in the apparatus.

In the state in which the adhesive 101 (cyanoacrylate-based adhesive) is applied to the blade attachment surface 41*s* of the development frame 30, the adhesive 101 is maintained with a dome-like cross-sectional shape (dome-shaped) due to viscosity and surface tension. However, with the viscosity and mobility of the cyanoacrylate-based adhesive, the dome-like shape thereof may be changed and the adhesive 101 may drip off from the blade attachment surface 41*s* because of the gravity if the development frame 30 is shaken or inclined. In other words, changing the orientation of a component to which the adhesive 101 is applied can cause the applied adhesive 101 to drip off from the blade attachment surface 41*s*.

Meanwhile, the hardening accelerator 102 (the hardening accelerator for the cyanoacrylate-based adhesive) exists in the form of liquid. When the hardening accelerator 102 is applied, the solvent which is acetone or alcohol evaporates in two to three seconds, so that an amine compound 103 remains in a dry state on the bonding surface 36*s* of the doctor blade 36 to which the hardening accelerator 102 is applied. The amine compound 103 that remains in the dry state is whitened, so that the operator can visually recognize the color changed to a whitish color. For verification, the doctor blade 36 is to be stripped off the blade attachment portion 41 in the state in which the bonding surface 36*s* of the doctor blade 36 and the blade attachment surface 41*s* of the development frame 30 are bonded together. The bonded doctor blade 36 is stripped off the blade attachment portion 41, and whether a change in color (specifically, of amine compound 103) to a whitish color can be observed on the bonding surface 36*s* of the doctor blade 36 or on the blade attachment surface 41*s* of the development frame 30 is checked. In this way, whether the adhesive 101 is applied to the bonding surface 36*s* of the doctor blade 36 or the blade attachment surface 41*s* of the development frame 30 and whether the hardening accelerator 102 is applied to the bonding surface 36*s* of the doctor blade 36 or the blade attachment surface 41*s* of the development frame 30*y* can be checked.

Figure 17:
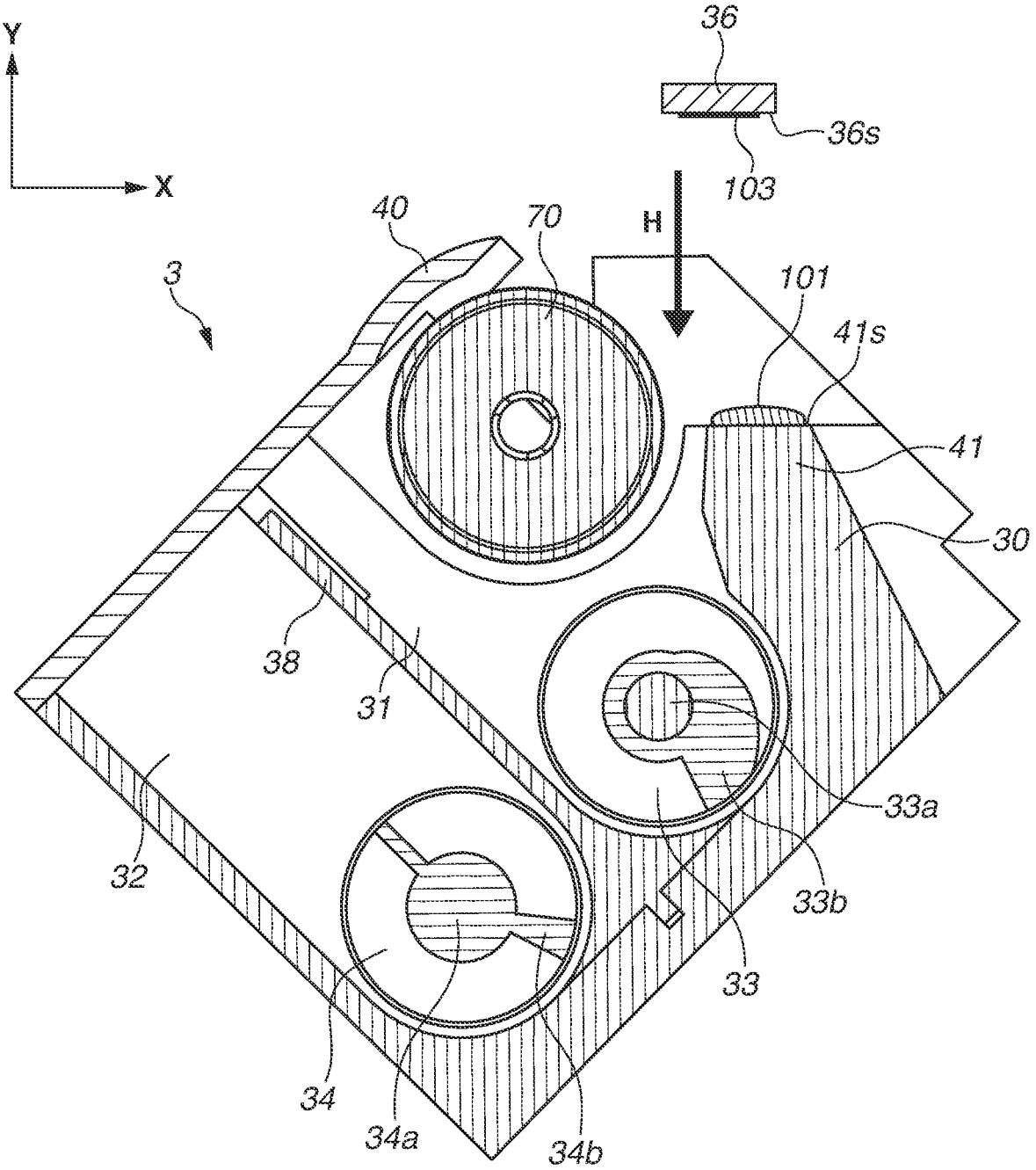
FIG. 17 is a schematic view illustrating orientations of the development frame and the doctor blade during bonding of the development frame and the doctor blade.

As described above, the hardening accelerator 102 (the hardening accelerator for the cyanoacrylate-based adhesive) exists in the form of liquid. When the hardening accelerator 102 is applied, the solvent, i.e., acetone or alcohol, evaporates in two to three seconds. Thus, the orientation of the component to which the hardening accelerator 102 is applied can be easily changed even immediately after the hardening accelerator 102 is applied. As illustrated in FIG. 17, after the solvent of the hardening accelerator 102 evaporates, the orientation of the doctor blade 36 can be changed upside down by 180 degrees or the doctor blade 36 can be moved in the direction of an arrow H in FIG. 17 (from the upper side in the vertical direction toward the lower side in the vertical direction) in order to bond the doctor blade 36 to the blade attachment portion 41.

As described above, in the first exemplary embodiment, the doctor blade 36 having the bonding surface 36*s* to which the hardening accelerator 102 is applied is moved from upper side in the vertical direction toward the lower side in the vertical direction. Thereafter, the doctor blade 36 is attached to the blade attachment surface 41*s* of the development frame 30 to which the adhesive 101 is applied. In this way, the doctor blade 36 is bonded to the blade attachment surface 41*s* of the development frame 30 via the adhesive 101 and the hardening accelerator 102.

As described above in the first exemplary embodiment, the doctor blade 36 to which the hardening accelerator 102 is applied is attached to the blade attachment surface 41*s* of the development frame 30 to which the adhesive 101 is applied in order to bond the doctor blade 36 to the blade attachment surface 41*s* of the development frame 30 via the adhesive 101 and the hardening accelerator 102.

While the example illustrated in FIG. 17 in which the position of the development frame 30 having the blade attachment surface 41*s* to which the adhesive 101 is applied is fixed and the doctor blade 36 having the bonding surface 36*s* to which the hardening accelerator 102 is applied is moved from the upper side in the vertical direction toward the lower side in the vertical direction is described, the configuration is not limited to the above-described example.

In a modified example, the position of the doctor blade 36 having the bonding surface 36*s* to which the hardening accelerator 102 is applied is fixed, and the development frame 30 having the blade attachment surface 41*s* to which the adhesive 101 is applied is moved from the lower side in the vertical direction toward the upper side in the vertical direction.

In another modified example, the position of the doctor blade 36 having the bonding surface 36*s* to which the hardening accelerator 102 is applied is moved from the upper side in the vertical direction toward the lower side in the vertical direction, and the development frame 30 having the blade attachment surface 41*s* to which the adhesive 101 is applied is moved from the lower side in the vertical direction toward the upper side in the vertical direction.

Further, as described above, in the second exemplary embodiment, the doctor blade 36 to which the adhesive 101 is applied is attached to the blade attachment surface 41*s* of the development frame 30 to which the hardening accelerator 102 is applied in order to bond the doctor blade 36 to the blade attachment surface 41*s* of the development frame 30 via the adhesive 101 and the hardening accelerator 102.

For example, the position of the doctor blade 36 having the bonding surface 36*s* to which the adhesive 101 is applied is fixed, and the development frame 30 having the blade attachment surface 41*s* to which the hardening accelerator 102 is applied is moved from the upper side in the vertical direction toward the lower side in the vertical direction.

In a modified example, the position of the development frame 30 having the blade attachment surface 41*s* to which the hardening accelerator 102 is applied is fixed, and the doctor blade 36 with the bonding surface 36*s* to which the adhesive 101 is applied is moved from the lower side in the vertical direction to the upper side in the vertical direction.

In another modified example, the development frame 30 having the blade attachment surface 41*s* to which the hardening accelerator 102 is applied is moved from the upper side in the vertical direction to the lower side in the vertical direction, and the doctor blade 36 having the bonding surface 36*s* to which the adhesive 101 is applied is moved from the lower side in the vertical direction to the upper side in the vertical direction.

(Other Exemplary Embodiments)

The above-described exemplary embodiments are not intended to limit the scope of the claimed disclosure, and various modifications (including various combinations of the exemplary embodiments) are possible based on the spirit of the disclosure and are not excluded from the scope of the claimed disclosure.

While the image forming apparatus 60 using the ITB 61 as an intermediate transfer member as illustrated in FIG. 1 is described as an example in the above-described exemplary embodiments, the structure is not limited to the above-described structure. The present disclosure is also applicable to an image forming apparatus configured to sequentially bring recording materials into direct contact with the photosensitive drum 1 to perform transfer processing.

Further, while the development apparatus 3 is described as a single unit in the above-described exemplary embodiments, the image forming unit 600 (refer to FIG. 1) including the development apparatus 3 can be integrated into a unit in form of a process cartridge which is removable from and attachable to the image forming apparatus 60. A similar advantage is also produced by the process cartridge. Further, the present disclosure is applicable to any image forming apparatus 60 including the development apparatus 3 or the process cartridge regardless of whether the image forming apparatus 60 is a monochrome image forming apparatus or color image forming apparatus.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Applications No. 2018-125047, filed Jun. 29, 2018, and No. 2019-092305, filed May 15, 2019, which are hereby incorporated by reference herein in their entirety.

What is claimed is:

1. A method of attaching a regulating blade made of resin to an attachment portion of a development frame which is made of resin and includes the attachment portion for attaching the regulating blade, the regulating blade being disposed opposite to and not in contact with a development rotary member configured to bear and convey a developer toward a position at which an electrostatic image formed on an image bearing member is developed, the regulating blade being configured to regulate an amount of the developer to be borne on the development rotary member, the method of attaching the regulating blade comprising:

a first application step of applying an adhesive to the attachment portion;

a second application step of applying a hardening accelerator to the regulating blade; and an attaching step of attaching the regulating blade to the attachment portion via the adhesive applied to the attachment portion in the first application step and the hardening accelerator applied to the regulating blade in the second application step.

2. The method of attaching the regulating blade according to claim 1, further comprising:

a moving step of moving, from an upper side to a lower side in a vertical direction, the regulating blade to which the hardening accelerator is applied in the second application step, wherein, in the attaching step, the regulating blade moved from the upper side to the lower side in the vertical direction in the moving step is attached to the attachment portion via the adhesive applied to the attachment portion in the first application step and the hardening accelerator applied to the regulating blade in the second application step.

3. The method of attaching the regulating blade according to claim 1, further comprising:

a moving step of moving, from a lower side to an upper side in a vertical direction, the attachment portion to which the adhesive is applied in the first application step, wherein, in the attaching step, the regulating blade is attached to the attachment portion moved from the lower side to the upper side in the vertical direction via the adhesive applied to the attachment portion in the first application step and the hardening accelerator applied to the regulating blade in the second application step.

4. The method of attaching the regulating blade according to claim 1, further comprising:

a first moving step of moving, from a lower side to an upper side in a vertical direction, the attachment portion to which the adhesive is applied in the first application step; and a second moving step of moving, from the upper side to the lower side in the vertical direction, the regulating blade to which the hardening accelerator is applied in the second application step, wherein, in the attaching step, the regulating blade moved from the upper side to the lower side in the vertical direction in the second moving step is attached to the attachment portion moved from the lower side to the upper side in the vertical direction in the first moving step via the adhesive applied to the attachment portion in the first application step and the hardening accelerator applied to the regulating blade in the second application step.

5. The method of attaching the regulating blade according to claim 1, further comprising:

an exerting step of exerting, on the regulating blade, a force for warping the regulating blade, wherein, in the attaching step, the regulating blade is attached to the attachment portion in a state that the regulating blade is kept warped by the force exerted on the regulating blade in the exerting step.

6. The method of attaching the regulating blade according to claim 5, wherein, in the exerting step, the force for warping the regulating blade is exerted on the regulating blade to which the hardening accelerator is applied in the second application step.

7. The method of attaching the regulating blade according to claim 1, wherein, in the first application step, the adhesive is applied to the attachment portion across a substantially entire region of the attachment portion that corresponds to a maximum image region of the image bearing member where an image is formable on the image bearing member.

8. The method of attaching the regulating blade according to claim 1, wherein, in the second application step, the hardening accelerator is applied to the regulating blade across a substantially entire region of the regulating blade that corresponds to a maximum image region of the image bearing member where an image is formable on the image bearing member.

9. A method of attaching a regulating blade made of resin to an attachment portion of a development frame which is made of resin and includes the attachment portion for attaching the regulating blade, the regulating blade being disposed opposite to and not in contact with a development rotary member configured to bear and convey a developer toward a position at which an electrostatic image formed on an image bearing member is developed, the regulating blade being configured to regulate an amount of the developer to be borne on the development rotary member, the method of attaching the regulating blade comprising:

a first application step of applying an adhesive to the regulating blade;

a second application step of applying a hardening accelerator to the attachment portion; and an attaching step of attaching the regulating blade to the attachment portion via the adhesive applied to the regulating blade in the first application step and the hardening accelerator applied to the attachment portion in the second application step.

10. The method of attaching the regulating blade according to claim 9, further comprising:

a moving step of moving, from an upper side to a lower side in a vertical direction, the attachment portion to which the hardening accelerator is applied in the second application step, wherein, in the attaching step, the regulating blade is attached to the attachment portion moved from the upper side to the lower side in the vertical direction in the moving step via the adhesive applied to the regulating blade in the first application step and the hardening accelerator applied to the attachment portion in the second application step.

11. The method of attaching the regulating blade according to claim 9, further comprising:

a moving step of moving, from a lower side to an upper side in a vertical direction, the regulating blade to which the adhesive is applied in the first application step, wherein, in the attaching step, the regulating blade moved from the lower side to the upper side in the vertical direction in the moving step is attached to the attachment portion via the adhesive applied to the regulating blade in the first application step and the hardening accelerator applied to the attachment portion in the second application step.

12. The method of attaching the regulating blade according to claim 9, further comprising:

a first moving step of moving, from a lower side to an upper side in a vertical direction, the regulating blade to which the adhesive is applied in the first application step; and a second moving step of moving, from the upper side to the lower side in the vertical direction, the attachment portion to which the hardening accelerator is applied in the second application step, wherein, in the attaching step, the regulating blade moved from the lower side to the upper side in the vertical direction in the first moving step is attached to the attachment portion moved from the upper side to the lower side in the vertical direction in the second moving step via the adhesive applied to the regulating blade in the first application step and the hardening accelerator applied to the attachment portion in the second application step.

13. The method of attaching the regulating blade according to claim 9, further comprising:

an exerting step of exerting, on the regulating blade, a force for warping the regulating blade, wherein, in the attaching step, the regulating blade is attached to the attachment portion in a state that the regulating blade is kept warped by the force exerted on the regulating blade in the exerting step.

14. The method of attaching the regulating blade according to claim 13, wherein, in the exerting step, the force for warping the regulating blade is exerted on the regulating blade to which the adhesive is applied in the first application step.

15. The method of attaching the regulating blade according to claim 9, wherein, in the first application step, the adhesive is applied to the regulating blade across a substantially entire region of the regulating blade that corresponds to a maximum image region of the image bearing member where an image is formable on the image bearing member.

16. The method of attaching the regulating blade according to claim 9, wherein, in the second application step, the hardening accelerator is applied to the attachment portion across a substantially entire region of the attachment portion that corresponds to a maximum image region of the image bearing member where an image is formable on the image bearing member.

17. A development apparatus comprising:

a development rotary member configured to bear and convey a developer toward a position at which an electrostatic image formed on an image bearing member is developed;

a regulating blade made of resin and disposed opposite to and not in contact with the development rotary member, the regulating blade being configured to regulate an amount of the developer to be borne on the development rotary member; and a development frame made of resin and including an attachment portion for attaching the regulating blade, wherein the regulating blade is bonded to the attachment portion via an adhesive and a hardening accelerator.

18. The development apparatus according to claim 17, wherein the regulating blade is bonded to the attachment portion across a substantially entire region of the regulating blade that corresponds to a maximum image region of the image bearing member where an image is formable on the image bearing member.

19. The development apparatus according to claim 17, wherein the regulating blade is bonded to the attachment portion via the adhesive provided to the attachment portion and the hardening accelerator provided to the regulating blade.

20. The development apparatus according to claim 17, wherein the regulating blade is bonded to the attachment portion via the adhesive provided to the regulating blade and the hardening accelerator provided to the attachment portion.

* * * * *